US012550976B2

(12) United States Patent
Sakamoto

(10) Patent No.: US 12,550,976 B2
(45) **Date of Patent: *Feb. 17, 2026**

(54) SHOE SOLE AND SHOE

(71) Applicant: ASICS CORPORATION, Kobe (JP)

(72) Inventor: Masanori Sakamoto, Kobe (JP)

(73) Assignee: ASICS CORPORATION, Kobe (JP)

( * ) Notice: Subject to any disclaimer, the term of this patent is extended or adjusted under 35 U.S.C. 154(b) by 103 days.

This patent is subject to a terminal disclaimer.

(21) Appl. No.: 18/194,329

(22) Filed: Mar. 31, 2023

(65) Prior Publication Data

US 2023/0309652 A1 Oct. 5, 2023

(30) Foreign Application Priority Data

Apr. 4, 2022 (JP) ..... 2022-062637

(51) Int. Cl.
*A43B 13/18* (2006.01)
*A43B 13/12* (2006.01)
*A43B 13/16* (2006.01)

(52) U.S. Cl.
CPC ..... *A43B 13/181* (2013.01); *A43B 13/127* (2013.01); *A43B 13/125* (2013.01);
(Continued)

(58) Field of Classification Search
CPC ... A43B 13/181; A43B 13/186; A43B 13/188; A43B 13/16; A43B 13/125; A43B 7/1415; A43B 1/0009; A43B 21/32
See application file for complete search history.

(56) References Cited

U.S. PATENT DOCUMENTS 2,432,533 A * 12/1947 Margolin ..... A43B 7/06 36/3 B
4,292,375 A * 9/1981 Ko ..... B21D 26/055 244/119

(Continued)

FOREIGN PATENT DOCUMENTS

CN 113273765 A 8/2021
EP 3 841 905 A1 6/2021

(Continued)

OTHER PUBLICATIONS

Communication pursuant to Article 94(3) EPC issued by the European Patent Office on Jun. 10, 2024, which corresponds to European Patent Application No. 23161425.6-1015 and is related to U.S. Appl. No. 18/194,329.

(Continued)

*Primary Examiner* — Khoa D Huynh
*Assistant Examiner* — Giao Qt Hoang
(74) *Attorney, Agent, or Firm* — Studebaker Brackett PLLC

(57) ABSTRACT

A shoe sole includes a shock absorber that buckles when the shock absorber receives compressive force applied in a normal direction to a ground contact surface. When a load is applied to the shoe sole, the shock absorber starts to buckle in a state in which a stress occurring in the shock absorber is within a range from 0.15 MPa to 0.80 MPa and a strain of the shock absorber is within a range from 10% to 60%. When a time point at which a strain energy density of the shock absorber reaches 0.157 J/cm$^3$ is defined as a specific time point, a maximum value of the stress occurring in the shock absorber until the specific time point is 0.80 MPa or less, and a tangential elastic modulus of the shock absorber at the specific time point is 5.00 MPa or less.

16 Claims, 31 Drawing Sheets

(52) U.S. Cl.
CPC ..... *A43B 13/16* (2013.01); *A43B 13/186* (2013.01); *A43B 13/188* (2013.01)

(56) References Cited

U.S. PATENT DOCUMENTS

| | | | | |
|---|---|---|---|---|
| 7,089,690 | B2 * | 8/2006 | Krstic | A43B 23/028 36/3 R |
| 10,881,167 | B2 | 1/2021 | Jeng et al. | |
| 10,945,489 | B2 | 3/2021 | Conrad et al. | |
| 11,116,284 | B2 * | 9/2021 | Campos, II | A43B 13/206 |
| 11,399,593 | B2 | 8/2022 | Cross et al. | |
| 2002/0144429 | A1 | 10/2002 | Hay | |
| 2004/0107601 | A1 | 6/2004 | Schmid | |
| 2006/0277788 | A1 | 12/2006 | Fujii | |
| 2007/0169376 | A1 | 7/2007 | Hatfield et al. | |
| 2011/0138652 | A1 | 6/2011 | Lucas et al. | |
| 2012/0021167 | A1 * | 1/2012 | Plant | A41D 19/01523 428/116 |
| 2012/0180341 | A1 | 7/2012 | Crowley, II et al. | |
| 2012/0315456 | A1 | 12/2012 | Scarpa et al. | |
| 2014/0026438 | A1 | 1/2014 | Cortez et al. | |
| 2014/0202031 | A1 | 7/2014 | Seo | |
| 2015/0033581 | A1 * | 2/2015 | Barnes | A43B 13/188 36/83 |
| 2015/0230548 | A1 | 8/2015 | Cross | |
| 2015/0245685 | A1 * | 9/2015 | Cross | A43B 1/0009 12/146 B |
| 2016/0058121 | A1 | 3/2016 | Langvin et al. | |
| 2016/0157557 | A1 * | 6/2016 | Cross | A43B 13/223 36/25 R |
| 2016/0157558 | A1 * | 6/2016 | Cross | A43B 13/187 36/25 R |
| 2017/0265565 | A1 | 9/2017 | Connell et al. | |
| 2018/0049514 | A1 | 2/2018 | Guyan et al. | |
| 2018/0228401 | A1 | 8/2018 | Schwartz et al. | |
| 2018/0264719 | A1 | 9/2018 | Rolland et al. | |
| 2018/0317600 | A1 * | 11/2018 | Campos | A43B 13/187 |
| 2019/0231018 | A1 | 8/2019 | Boutin | |
| 2019/0320759 | A1 * | 10/2019 | Conrad | A43B 13/181 |
| 2019/0357621 | A1 | 11/2019 | Nauman et al. | |
| 2020/0068988 | A1 | 3/2020 | Hsiao | |
| 2020/0093221 | A1 * | 3/2020 | Caldwell | A43B 1/0009 |
| 2020/0229538 | A1 | 7/2020 | Yoshinaga et al. | |
| 2020/0268098 | A1 * | 8/2020 | Jeng | A43B 13/181 |
| 2020/0281313 | A1 | 9/2020 | Connell et al. | |
| 2021/0161250 | A1 | 6/2021 | Conrad et al. | |
| 2021/0186152 | A1 * | 6/2021 | Kumar | A43B 13/125 |
| 2021/0195989 | A1 * | 7/2021 | Iwasa | A43B 7/1415 |
| 2021/0195995 | A1 * | 7/2021 | Sakamoto | A43B 7/32 |
| 2022/0225732 | A1 | 7/2022 | Nasu et al. | |
| 2022/0275845 | A1 | 9/2022 | Kabaria et al. | |
| 2023/0225452 | A1 | 7/2023 | Sakamoto | |

FOREIGN PATENT DOCUMENTS

| | | | |
|---|---|---|---|
| JP | H10-295409 | A | 11/1998 |
| JP | 2002-238609 | A | 8/2002 |
| JP | 2006-345886 | A | 12/2006 |
| JP | 2011-120915 | A | 6/2011 |
| JP | 2017-527637 | A | 9/2017 |
| JP | 2021-521923 | A | 8/2021 |
| JP | 2021-186336 | A | 12/2021 |
| JP | 2021-186337 | A | 12/2021 |
| WO | 2015/200201 | A1 | 12/2015 |
| WO | 2021/024341 | A1 | 2/2021 |

OTHER PUBLICATIONS

The extended European search report issued by the European Patent Office on Sep. 12, 2023, which corresponds to European Patent Application No. 23161425.6-1015 and is related to U.S. Appl. No. 18/194,329.

An Office Action mailed by the United States Patent and Trademark Office on Jun. 21, 2024, which corresponds to U.S. Appl. No. 18/154,799.

An Office Action mailed by the United States Patent and Trademark Office on Mar. 20, 2025, which corresponds to U.S. Appl. No. 18/154,799.

A Notice of Allowance mailed by the United States Patent and Trademark Office on Jul. 11, 2025, which corresponds to U.S. Appl. No. 18/154,799.

The extended European search report issued by the European Patent Office on May 19, 2023, which corresponds to European Patent Application No. 23151329.2-1015.

An Office Action, "Notice of Reasons for Refusal," mailed by the Japanese Patent Office on Nov. 18, 2025, which corresponds to Japanese Patent Application No. 2022-004976; with English language translation.

An Office Action, "Notice of Reasons for Refusal," mailed by the Japanese Patent Office on Nov. 18, 2025, which corresponds to Japanese Patent Application No. 2022-062637; with English language translation.

* cited by examiner

| | | COMPARATIVE EXAMPLE 1 | COMPARATIVE EXAMPLE 2 | COMPARATIVE EXAMPLE 3 |
|---|---|---|---|---|
| SPECIFIC GRAVITY [g/cm$^3$] | | 0.900 | 0.170 | 0.259 |
| BUCKLING START POINT | STRESS $\sigma$ [MPa] | – | 0.07 | 0.04 |
| | STRAIN $\varepsilon$ [%] | – | 6.6 | 2.5 |
| MAXIMUM STRESS $\sigma_{max}$ [MPa] | | 0.94 | 0.91 | 0.84 |
| SPECIFIC TIME POINT | TANGENTIAL ELASTIC MODULUS [MPa] | 5.78 | 7.40 | 5.40 |

| | | COMPARATIVE EXAMPLE 3 | EXAMPLE |
|---|---|---|---|
| SPECIFIC GRAVITY [g/cm$^3$] | | 0.259 | 0.280 |
| BUCKLING START POINT | STRESS $\sigma$ [MPa] | 0.04 | 0.55 |
| | STRAIN $\varepsilon$ [%] | 2.5 | 31.0 |
| MAXIMUM STRESS $\sigma_{max}$ [MPa] | | 0.84 | 0.59 |
| SPECIFIC TIME POINT | TANGENTIAL ELASTIC MODULUS [MPa] | 5.40 | 1.35 |

| | | COMPARATIVE EXAMPLE 3 | VERIFICATION EXAMPLE 1 |
|---|---|---|---|
| BUCKLING START POINT | STRESS $\sigma$ [MPa] | 0.04 | 0.50 |
| | STRAIN $\varepsilon$ [%] | 2.5 | 24.0 |
| MAXIMUM STRESS $\sigma_{max}$ [MPa] | | 0.84 | 0.53 |
| SPECIFIC TIME POINT | TANGENTIAL ELASTIC MODULUS [MPa] | 5.40 | −0.16 |

FIG.13

| | | VERIFICATION EXAMPLE 2 | VERIFICATION EXAMPLE 3 | VERIFICATION EXAMPLE 4 | VERIFICATION EXAMPLE 5 | VERIFICATION EXAMPLE 6 | VERIFICATION EXAMPLE 7 |
|---|---|---|---|---|---|---|---|
| OCCUPIED VOLUME RATIO [%] | | 20 | 20 | 20 | 20 | 20 | 40 |
| ELASTIC MODULUS OF BASE MATERIAL [MPa] | | 4 | 12 | 30 | 40 | 50 | 5 |
| BUCKLING START POINT | STRESS $\sigma$ [MPa] | 0.07 | 0.20 | 0.49 | 0.66 | 0.82 | 0.47 |
| | STRAIN $\varepsilon$ [%] | 19.0 | 19.0 | 19.0 | 19.0 | 19.0 | 42.0 |
| MAXIMUM STRESS $\sigma_{max}$ [MPa] | | 1.67 | 0.70 | 0.52 | 0.71 | 0.88 | 0.50 |
| SPECIFIC TIME POINT | TANGENTIAL ELASTIC MODULUS [MPa] | 30.07 | 4.49 | −0.24 | −0.47 | −1.25 | 1.48 |

| | | COMPARATIVE EXAMPLE 3 | VERIFICATION EXAMPLE 8 |
|---|---|---|---|
| BUCKLING START POINT | STRESS σ [MPa] | 0.04 | 0.39 |
| | STRAIN ε [%] | 2.5 | 18.0 |
| MAXIMUM STRESS $\sigma_{max}$ [MPa] | | 0.84 | 0.43 |
| SPECIFIC TIME POINT | TANGENTIAL ELASTIC MODULUS [MPa] | 5.40 | −0.50 |

SHOE SOLE AND SHOE

CROSS REFERENCE TO RELATED APPLICATIONS

This nonprovisional application is based on Japanese Patent Application No. 2022-062637 filed on Apr. 4, 2022 with the Japan Patent Office, the entire contents of which are hereby incorporated by reference.

BACKGROUND OF THE INVENTION

Field of the Invention

The present invention relates to a shoe sole including a shock absorber and a shoe including the shoe sole.

Description of the Background Art

A shoe sole including a shock absorber and a shoe including the shoe sole have conventionally been known. The shock absorber is provided in the shoe sole for the purpose of alleviating the impact received on contact with the ground, and is generally often formed of a solid body or a hollow body made of resin or rubber.

For example, U.S. Patent Publication No. 2020/0281313 discloses a shoe configured such that a shock absorber formed of a hollow body made of resin is disposed between a highly rigid plate embedded in a shoe sole and an outsole defining a ground contact surface of the shoe sole.

In recent years, there has been developed a shoe having a shoe sole including an area having a lattice structure or a web structure to thereby enhance the shock absorbing performance in terms not only of material but also of structure. A shoe having a shoe sole including an area having a lattice structure is disclosed, for example, in U.S. Patent Publication No. 2018/0049514.

Further, Japanese National Patent Publication No. 2017-527637 explains that a three-dimensional object manufactured by a three-dimensional additive manufacturing method can be manufactured by adding a thickness to a geometrical surface structure, such as a polyhedron or a triply periodic minimal surface having a cavity therein, and discloses that the three-dimensional object is formed of an elastic material and thereby can be applicable as a shock absorber, for example, to a shoe sole.

SUMMARY OF THE INVENTION

In general, in order to enhance the shock absorbing performance of the shoe sole, it is effective that the stress occurring in the shoe sole at the time point when the strain energy accumulated in the shoe sole during the foot landing action becomes maximum is suppressed to be smaller. Various studies have been made in terms of material and structure such that the shock absorber satisfies such conditions, but there is still a large margin for improvement and the shock absorbing performance needs to be further improved.

Thus, an object of the present invention is to provide a shoe sole enhanced in shock absorbing performance and a shoe including the shoe sole.

A shoe sole according to the present invention includes a shock absorber and has a bottom surface configured as a ground contact surface and a top surface located opposite to the bottom surface. The shock absorber has a three-dimensional shape formed by a wall having an outer shape defined by a pair of parallel flat or curved surfaces, and may buckle when the shock absorber receives compressive force applied in a normal direction to the bottom surface. In the shoe sole according to the present invention, when a load is applied to the shoe sole in a gradually increasing manner such that compressive force is applied to the shock absorber in the normal direction, the shock absorber starts to buckle in a state in which a stress occurring in the shock absorber is within a range from 0.15 MPa or more to 0.80 MPa or less and a strain of the shock absorber in the normal direction is within a range from 10% or more to 60% or less. When a time point at which a strain energy density of the shock absorber reaches 0.157 J/cm$^3$ is defined as a specific time point, a maximum value of the stress occurring in the shock absorber from start of application of the compressive force to the shock absorber until the specific time point is 0.80 MPa or less, and a tangential elastic modulus of the shock absorber at the specific time point is 5.00 MPa or less.

A shoe according to the present invention includes: the shoe sole according to the present invention; and an upper provided above the shoe sole.

The foregoing and other objects, features, aspects and advantages of the present invention will become apparent from the following detailed description of the present invention when taken in conjunction with the accompanying drawings.

BRIEF DESCRIPTION OF THE DRAWINGS

FIG. 13 is a table showing characteristics of the shock absorbers according to Verification Examples 2 to 7.

DESCRIPTION OF THE PREFERRED EMBODIMENTS

Figure 1A:
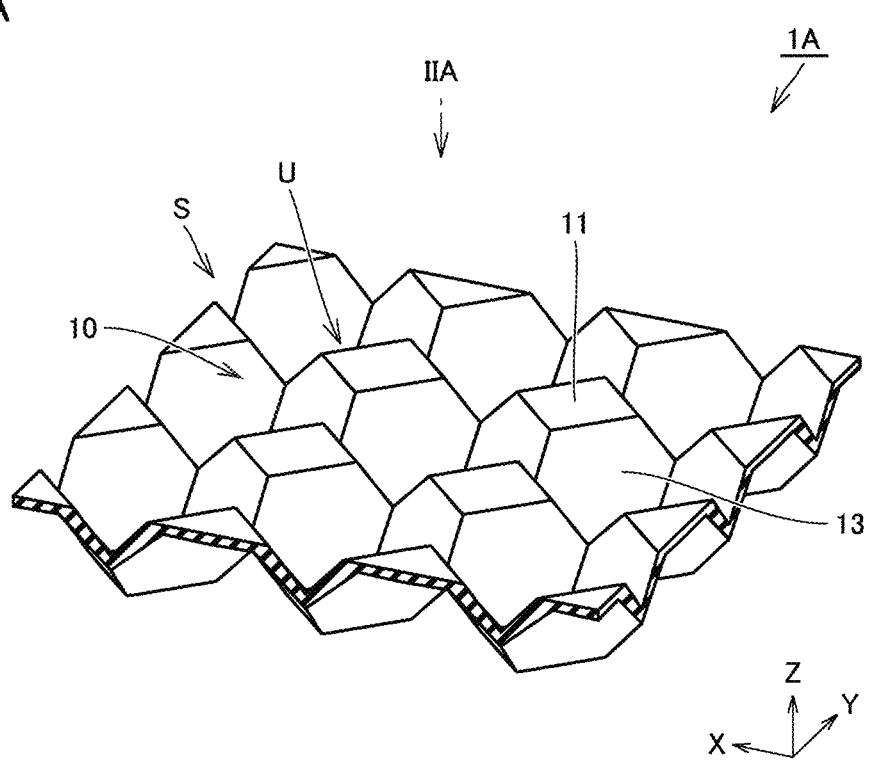
FIG. 1A is a perspective view of a shock absorber basically similar in structure to a shock absorber included in a shoe sole according to an embodiment.

The following describes embodiments of the present invention in detail with reference to the accompanying drawings. In the embodiments described below, the same or common portions are denoted by the same reference characters, and the description thereof will not be repeated.

Figure 1B:
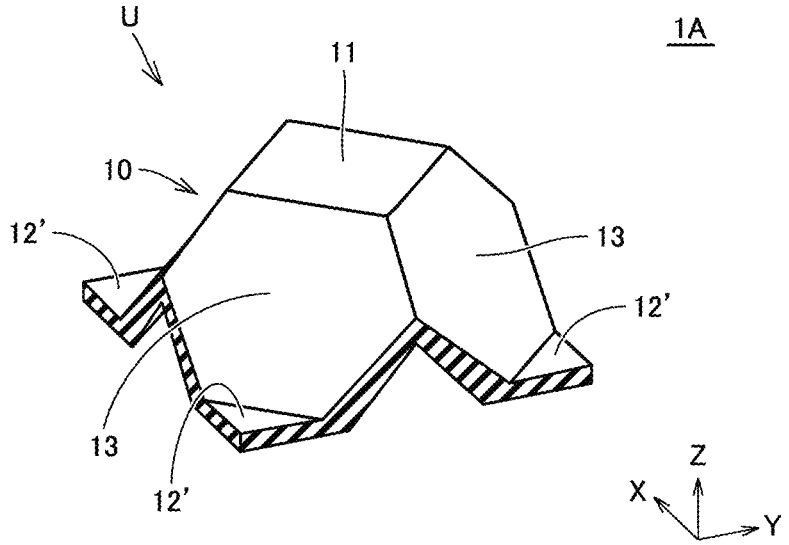
FIG. 1B is a perspective view of a unit structure body forming the shock absorber shown in FIG. 1A.
Figure 2A:
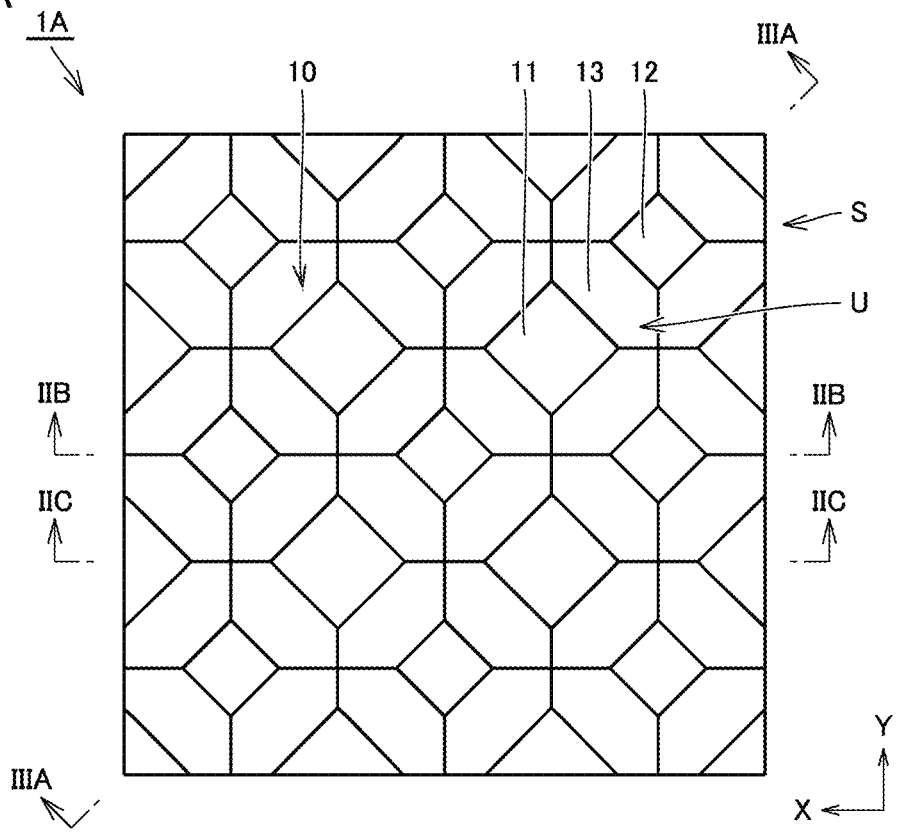
FIG. 2A is a plan view of the shock absorber shown in FIG. 1A.
Figure 2B:
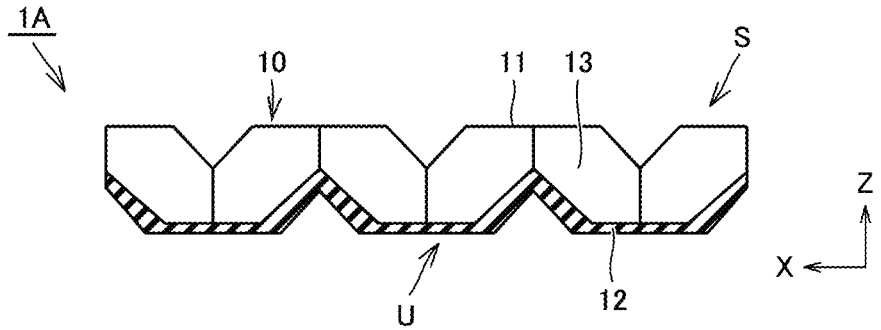
FIGS. 2B and 2C each are a cross-sectional view of the shock absorber shown in FIG. 1A.
Figure 2C:
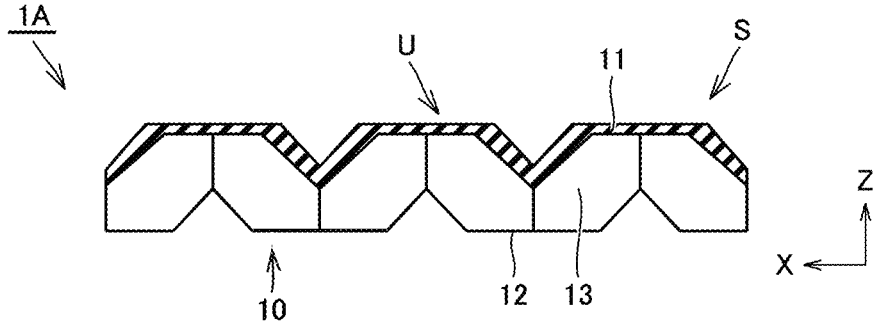

Shock Absorber Basically Similar in Structure to Shock Absorber Included in Shoe Sole According to Embodiment FIG. 1A is a perspective view of a shock absorber basically similar in structure to a shock absorber included in a shoe sole according to an embodiment, and FIG. 1B is a perspective view of a unit structure body forming the shock absorber. FIG. 2A is a plan view of the shock absorber shown in FIG. 1A when viewed in a direction indicated by an arrow IIA shown in FIG. 1A, and FIGS. 2B and 2C are cross-sectional views taken along lines IIB-IIB and IIC-IIC, respectively, shown in FIG. 2A. Before describing a shoe sole according to the present embodiment and a shoe including the shoe sole, the following describes a configuration of a shock absorber 1A conforming in structure to the shock absorber included in the shoe sole with reference to FIGS. 1A, 1B, and 2A to 2C.

As shown in FIGS. 1A and 2A to 2C, the shock absorber 1A includes a three-dimensional structure S having a plurality of unit structure bodies U. Each of the plurality of unit structure bodies U has a three-dimensional shape formed by a wall 10 having an outer shape defined by a pair of parallel flat surfaces (see FIG. 1B). Thereby, the three-dimensional structure S also has a three-dimensional shape formed by the wall 10 having an outer shape defined by a pair of parallel flat surfaces.

The unit structure body U has a structure obtained by adding a thickness to a base structure unit having a geometrical surface structure. More specifically, the unit structure body U is formed by adding a thickness to each of divided structure units obtained by dividing a structure unit into two in one of its orthogonal three-axis directions, the structure unit being formed of a plurality of flat surfaces disposed to intersect with each other and be hollow inside.

In this case, in the unit structure body U shown in FIG. 1B, the above-mentioned surface structure is a Kelvin structure, and the unit structure body U is formed by adding a thickness to each of divided structure units obtained by dividing a structure unit having a Kelvin structure into two in a height direction (in a Z-axis direction shown in the figure) among the orthogonal three-axis directions.

More specifically, the unit structure body U includes: one upper wall portion 11; four divided lower wall portions 12'; and four upright wall portions 13 each connecting the upper wall portion 11 and a corresponding one of the lower wall portions 12'. Each of the upright wall portions 13 extends to intersect with the upper wall portion 11 and a corresponding one of the lower wall portions 12', and is connected on its both side ends to adjacent upright wall portions 13. Thus, the four upright wall portions 13 entirely form an annular shape. Note that each of the upper wall portion 11, the lower wall portions 12', and the upright wall portions 13 has a flat plate shape.

Each of the four divided lower wall portions 12' included in one unit structure body U is arranged continuously to, and thereby integrated with, one of the lower wall portions 12' included in another unit structure body U adjacent to the one unit structure body U. Thus, in the three-dimensional structure S, each of the lower wall portions 12' included in each of four unit structure bodies U adjacent to each other is arranged continuously to an adjacent lower wall portion 12' included in a corresponding one of these four unit structure bodies U, to thereby form one lower wall portion 12 substantially similar in shape to the above-mentioned one upper wall portion 11 (see FIG. 2A and the like).

The shock absorber 1A according to the present embodiment is intended to exhibit a shock absorbing function in the above-mentioned height direction. Thus, as shown in FIGS. 1A and 2A to 2C, the plurality of unit structure bodies U are repeatedly arranged in a regular and continuous manner in each of a width direction (an X direction shown in the figure) and a depth direction (a Y direction shown in the figure) among the orthogonal three-axis directions. Thereby, the three-dimensional structure S has a structure in which upward protruding portions and downward protruding portions are alternately arranged in a plan view. FIGS. 1A and 2A to 2C each show only three unit structure bodies U arranged adjacent to each other in the width direction and the depth direction.

In this case, the present embodiment is described with reference to the shock absorber 1A formed of a large number of unit structure bodies U arranged in the width direction and the depth direction, but the number of unit structure bodies U repeatedly arranged in the width direction and the depth direction is not particularly limited. Specifically, the shock absorber may be formed by arranging two or more unit structure bodies U in only one of the width direction and the depth direction, or may be formed of only a single unit structure body U.

While a method of manufacturing the shock absorber 1A is not particularly limited, the shock absorber 1A can be manufactured, for example, by molding such as injection molding using a mold, cast molding, sheet molding, additive manufacturing using a three-dimensional additive manufacturing apparatus, or the like. In particular, the above-described shock absorber 1A has a relatively simple shape, and therefore, can be manufactured easily by molding using a mold. This eliminates the need to perform additive manufacturing using a three-dimensional additive manufacturing apparatus or molding using a complicated mold, so that the manufacturing cost can be significantly reduced. Further, by manufacturing the shock absorber 1A by molding using a mold, the shock absorber 1A can be manufactured even with a material type by which the shock absorber 1A cannot be manufactured by additive manufacturing using a three-dimensional additive manufacturing apparatus. This increases the degree of freedom for material selection, and thus, a shock absorber having higher shock absorbing performance can be implemented.

The material of the shock absorber 1A may be basically any material as long as it has appropriate elastic force, but is preferably a resin material or a rubber material. More specifically, when the shock absorber 1A is made of resin, for example, the material of the shock absorber 1A may be a polyolefin resin, ethylene-vinyl acetate copolymer (EVA), polyamide-based thermoplastic elastomer (TPA, TPAE), thermoplastic polyurethane (TPU), and polyester-based thermoplastic elastomer (TPEE). On the other hand, when the shock absorber 1A is made of rubber, for example, butadiene rubber may be used.

The shock absorber 1A can be formed of a polymer composition. In that case, examples of polymer to be contained in the polymer composition include olefinic polymers such as olefinic elastomers and olefinic resins. Examples of the olefinic polymers include polyolefins such as polyethylene (e.g., linear low density polyethylene (LLDPE), high density polyethylene (HDPE), and the like), polypropylene, ethylene-propylene copolymer, propylene-1-hexene copolymer, propylene-4-methyl-1-pentene copolymer, propylene-1-butene copolymer, ethylene-1-hexene copolymer, ethylene-4-methyl-pentene copolymer, ethylene-1-butene copolymer, 1-butene-1-hexene copolymer, 1-butene-4-methyl-pentene, ethylene-methacrylic acid copolymer, ethylene-methyl methacrylate copolymer, ethylene-ethyl methacrylate copolymer, ethylene-butyl methacrylate copolymer, ethylene-methyl acrylate copolymer, ethylene-ethyl acrylate copolymer, ethylene-butyl acrylate copolymer, propylene-methacrylic acid copolymer, propylene-methyl methacrylate copolymer, propylene-ethyl methacrylate copolymer, propylene-butyl methacrylate copolymer, propylene-methyl acrylate copolymer, propylene-ethyl acrylate copolymer, propylene-butyl acrylate copolymer, ethylene-vinyl acetate copolymer (EVA), propylene-vinyl acetate copolymer, and the like.

The polymer may be an amide-based polymer such as an amide-based elastomer and an amide-based resin. Examples of the amide-based polymer include polyamide 6, polyamide 11, polyamide 12, polyamide 66, polyamide 610, and the like.

The polymer may be an ester-based polymer such as an ester-based elastomer and an ester-based resin. Examples of the ester-based polymer include polyethylene terephthalate and polybutylene terephthalate.

The polymer may be a urethane-based polymer such as a urethane-based elastomer and a urethane-based resin. Examples of the urethane-based polymer include polyester-based polyurethane and polyether-based polyurethane.

The polymer may be a styrene-based polymer such as a styrene-based elastomer and a styrene-based resin. Examples of the styrene-based elastomer include styrene-ethylene-butylene copolymer (SEB), styrene-butadiene-styrene copolymer (SBS), a hydrogenated product of SBS (styrene-ethylene-butylene-styrene copolymer (SEBS)), styrene-isoprene-styrene copolymer (SIS), a hydrogenated product of SIS (styrene-ethylene-propylene-styrene copolymer (SEPS)), styrene-isobutylene-styrene copolymer (SIBS), styrene-butadiene-styrene-butadiene (SBSB), styrene-butadiene-styrene-butadiene-styrene (SBSBS), and the like. Examples of the styrene-based resin include polystyrene, acrylonitrile styrene resin (AS), and acrylonitrile butadiene styrene resin (ABS).

Examples of the polymer include acrylic polymers such as polymethylmethacrylate, urethane-based acrylic polymers, polyester-based acrylic polymers, polyether-based acrylic polymers, polycarbonate-based acrylic polymers, epoxy-based acrylic polymers, conjugated diene polymer-based acrylic polymers and hydrogenated products thereof, urethane-based methacrylic polymers, polyester-based methacrylic polymers, polyether-based methacrylic polymers, polycarbonate-based methacrylic polymers, epoxy-based methacrylic polymers, conjugated diene polymer-based methacrylic polymers and hydrogenated products thereof, polyvinyl chloride-based resins, silicone-based elastomers, butadiene rubber (BR), isoprene rubber (IR), chloroprene rubber (CR), natural rubber (NR), styrene-butadiene rubber (SBR), acrylonitrile-butadiene rubber (NBR), butyl rubber (IIR), and the like.

Figure 3A:
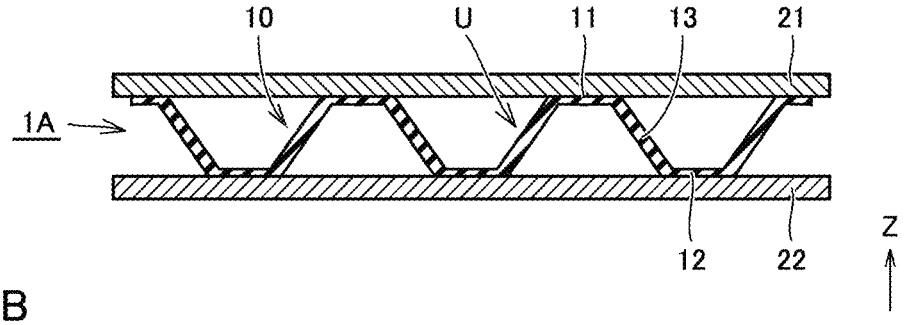
FIGS. 3A and 3B each schematically show buckling that may occur in the shock absorber shown in FIG. 1A.
Figure 3B:
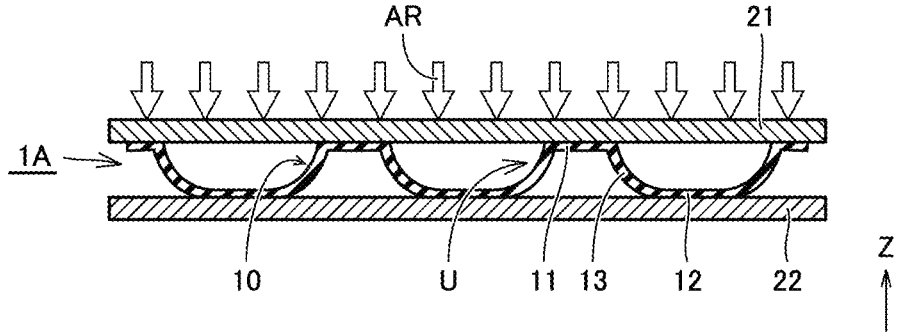

FIGS. 3A and 3B each schematically show buckling that may occur in the shock absorber shown in FIG. 1A. Referring to FIGS. 3A and 3B, the following describes buckling that may occur in the shock absorber 1A. Note that the cross section of the shock absorber 1A shown in each of FIGS. 3A and 3B is taken along a line IIIA-IIIA shown in FIG. 2A.

As shown in FIG. 3A, for example, in the state in which the shock absorber 1A is sandwiched in the height direction (in the Z-axis direction shown in the figure) between a pair of highly-rigid and flat-plate-shaped upper member 21 and lower member 22, the upper member 21 is gradually pressed toward the lower member 22 (i.e., in the direction indicated by arrows AR shown in FIG. 3B). In this case, a load is gradually applied to the shock absorber 1A in the height direction, with the result that the shock absorber 1A undergoes compressive deformation as shown in FIG. 3B. At this time, due to the structure of the shock absorber 1A, the upright wall portion 13 deforms, and then, a load at and above a certain level is applied to thereby cause buckling in the upright wall portion 13.

On the other hand, when this application of pressure is stopped, the load applied to the shock absorber 1A in the height direction decreases and disappears. Thereby, the compressive deformation occurring in the shock absorber 1A is undone and the shock absorber 1A returns to its original shape. At this time, buckling occurring in the shock absorber 1A also disappears.

Figure 4:
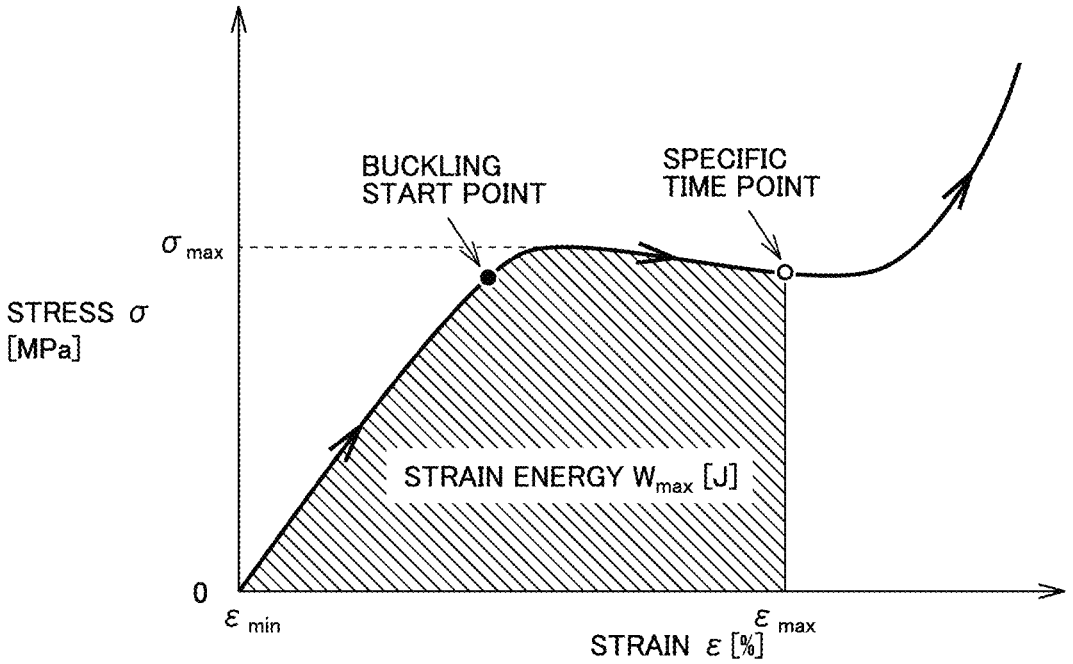
FIG. 4 is a graph showing shock absorbing performance of the shock absorber shown in FIG. 1A.
Figure 5:
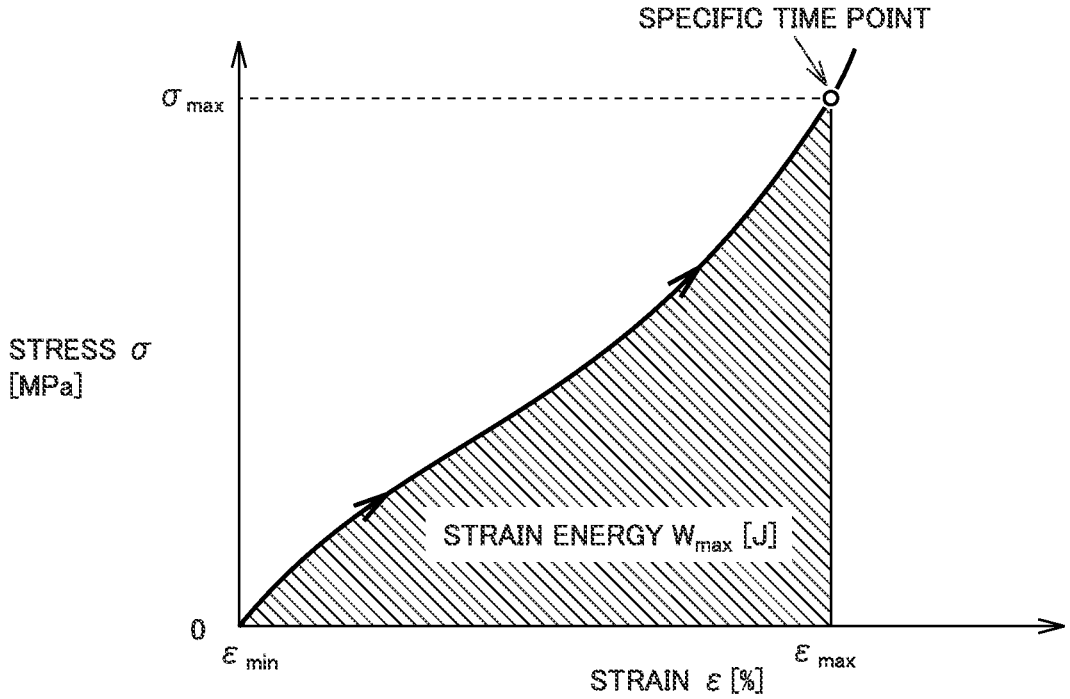
FIG. 5 is a graph showing shock absorbing performance of a commonly-used shock absorber.

FIG. 4 is a graph showing shock absorbing performance of the shock absorber shown in FIG. 1A, and FIG. 5 is a graph showing shock absorbing performance of a commonly-used shock absorber. The graphs shown in FIGS. 4 and 5 each are what is called a stress-strain curve that represents the correlation between stress and strain assuming that the vertical axis represents the stress occurring in the shock absorber while the horizontal axis represents the strain of the shock absorber.

As described above, buckling occurs in the shock absorber 1A due to its structure in a loading process in which a load is applied to the shock absorber 1A in a gradually increasing manner. The compressive deformation of the shock absorber 1A accompanied with buckling appears as a characteristic curve as described below in the stress-strain curve.

Specifically, as shown in FIG. 4, in the initial stage of the loading process, a stress $\sigma$ increases as a strain $\varepsilon$ increases, and accordingly, the stress-strain curve rises in an upward right direction. On the other hand, in the middle stage of the loading process, the stress $\sigma$ hardly changes even when the strain $\varepsilon$ increases, and accordingly, the stress-strain curve extends in a rightward direction. Then, in the final stage of the loading process, the stress $\sigma$ also increases as the strain $\varepsilon$ increases, and accordingly, the stress-strain curve again rises in the upward right direction.

On the other hand, buckling does not occur in a commonly-used shock absorber due to its structure in the loading process. Thus, the compressive deformation of the shock absorber appears as a characteristic curve as described below in the stress-strain curve.

Specifically, as shown in FIG. 5, from the initial stage to the final stage in the loading process, the stress $\sigma$ also continuously increases as the strain E increases, and accordingly, the stress-strain curve rises in an upward right direction.

In this case, as described above, in order to enhance the shock absorbing performance of the shoe sole, it is effective that the stress occurring in the shoe sole at the time point when the strain energy accumulated in the shoe sole during the foot landing action becomes maximum is suppressed to be smaller. The strain energy is represented by the area surrounded between the stress-strain curve in the loading process and the horizontal axis (the area of the diagonally shaded portion in each of the graphs shown in FIGS. 4 and 5). Assuming that the maximum value of the strain energy accumulated in the shoe sole during the foot landing action is defined as $W_{max}$, this $W_{max}$ is represented by the following equation (1). Note that $\varepsilon_{max}$ denotes strain at the time point when the foot landing action ends (normally, the strain at the time point when this foot landing action ends becomes maximum), and $\varepsilon_{min}$ denotes strain at the time point when the foot landing action starts (normally, no strain occurs at the time point when the foot landing action starts, and thus, the strain at this time point is 0%).

$$W_{max}=\int_{\varepsilon_{min}}^{\varepsilon_{max}}\sigma d\varepsilon \tag{1}$$

In general, a portion of the shoe sole to which the highest load is applied during the foot landing action is a portion that supports a heel of the wearer's foot, and the strain energy accumulated in this portion is about 5.0 J though it varies depending on the body weight, the body shape, the running method and the like of the wearer, or the road surface conditions and the like. Further, the shock absorber that can be provided in a portion of the shoe sole that supports the heel of the wearer's foot has a cylindrical shape having, at maximum, a diameter of 45 mm, a thickness of about 20 mm, and a volume of about 31.8 $cm^3$.

In consideration of the aforementioned points, the strain energy density of the shock absorber reaches about 0.157 $J/cm^3$ at the time point when the strain energy accumulated in the shoe sole during the foot landing action becomes maximum. Thus, when the time point at which the strain energy density of the shock absorber reaches 0.157 $J/cm^3$ is defined as a specific time point, it is important for enhancing the shock absorbing performance that the maximum value of the stress occurring in the shock absorber until the specific time point is smaller.

In this regard, due to occurrence of buckling in the shock absorber 1A during compressive deformation, in the middle stage of the loading process, the stress-strain curve has a region where the stress $\sigma$ hardly changes even when the strain E increases. Thus, if the shock absorber 1A can be configured such that such buckling starts at a prescribed level of stress and a prescribed level of strain, the maximum value of the stress occurring in the shock absorber until reaching the specific time point can be smaller than that in the case of a commonly-used shock absorber. As a result, high shock absorbing performance can be achieved.

In the case of a commonly-used shoe sole, the maximum stress occurring in the portion supporting the heel of the wearer's foot during the foot landing action is about 0.15 MPa to 0.95 MPa though it varies depending on the body weight, the body shape, the running method and the like of the wearer, the road surface conditions, or the like. Thus, from the viewpoint of suppressing the maximum stress, it is necessary for the aforementioned shock absorber 1A to start buckling in a range from about 0.15 MPa to 0.80 MPa. In the following description, the stress range from 0.15 MPa to 0.80 MPa in which buckling needs to start will be referred to as a "required stress range" for the sake of convenience.

In other words, in the shock absorber that starts buckling at a stress smaller than the required stress range, the loading process proceeds to the middle stage before the stress becomes appropriately large. Accordingly, at about the specific time point, the loading process leaves the middle stage and then proceeds to the final stage, and thus, the value of the stress occurring in the shoe sole at the aforementioned specific time point cannot be expected to be reduced. Also, in the case of the shock absorber that starts buckling at a stress greater than the required stress range, buckling essentially does not occur during running, and thus, the value of the stress occurring in the shoe sole at the aforementioned specific time point cannot be expected to be reduced.

On the other hand, while the strain occurring in the shock absorber during running varies depending not only on the body weight, the body shape, the running method and the like of the wearer, the road surface conditions or the like but also on the shape, the material and the like of the shock absorber, this strain is preferably about 10% to 60% in consideration of the facts that the shock absorbing performance is hardly achieved when the strain is too small and that the shoe sole significantly sinks when the strain is too large. Therefore, the shock absorber 1A needs to be configured to start buckling within this strain range. In the following description, the strain range from 10% to 60% in which buckling needs to be started is referred to as a "required strain range" for the sake of convenience.

In addition, the relatively small degree of buckling does not necessarily lead to a reduction in stress occurring in the shoe sole at the time point when the strain energy accumulated in the shoe sole during the foot landing action becomes maximum. In other words, in order to sufficiently reduce the stress occurring in the shoe sole at the time point when the strain energy accumulated in the shoe sole during the foot landing action becomes maximum, the middle stage needs to occur in the loading process over a certain extent of the strain range.

Further, the maximum value of the strain energy accumulated in the shoe sole during the foot landing action not only varies among different individuals but also varies variously even in the case of the same wearer depending on the running method, the road surface conditions, and the like. Thus, when such variations of the maximum value are taken into consideration, the specific time point at which the strain energy density of the shock absorber reaches 0.157 $J/cm^3$ needs to be reached in the middle stage in the loading process in which the stress σ hardly changes even when the strain E increases.

In view of the fact that the required stress range in which buckling is started is from 0.15 MPa to 0.80 MPa in consideration of the above circumstances, in order to reduce the value of the stress occurring in the shoe sole at the specific time point, the maximum value of the stress occurring in the shock absorber (i.e., a maximum stress $\sigma_{max}$ (see FIG. 4)) from the start of application of the compressive force to the shock absorber until the specific time point needs to be 0.80 MPa or less, and the tangential elastic modulus of the shock absorber at the specific time point needs to be 5.00 MPa or less. In other words, when these conditions are satisfied, sufficient buckling occurs in the shock absorber in the loading process, and further, variations resulting from the above-mentioned individual differences, running method, road surface conditions, and the like can be absorbed. As a result, a shoe sole capable of achieving stably high shock absorbing performance can be obtained.

Based on the viewpoint as described above, the present inventor conducted the following Verification Tests 1 to 4 to verify whether a shock absorber that is provided in a shoe sole and thereby can achieve high shock absorbing performance can be implemented or not. These Verification Tests 1 to 4 will be hereinafter sequentially described. In the following description, a point at which buckling starts in the loading process will be referred to as a "buckling start point" for the sake of convenience.

<Verification Test 1>

In Verification Test 1, a plurality of shock absorbers used in commonly available shoe soles were prepared, and the shock absorbing performance of each of these shock absorbers was actually measured. A total of three types of shock absorbers according to Comparative Examples 1 to 3 were prepared, and their stress-strain curves were obtained using Autograph AGX-50 kN manufactured by Shimadzu Corporation as a measuring device. As for the test conditions, the compression rate was set at 1%/s, and the maximum pressure was set at 1.00 MPa.

Figure 6:
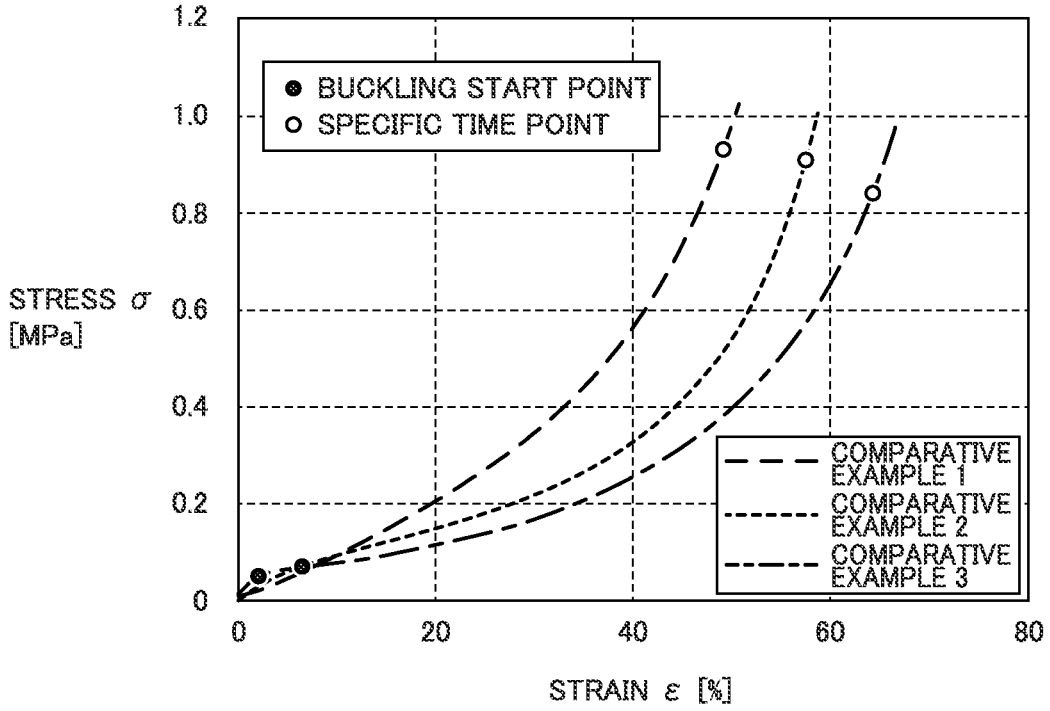
FIG. 6 is a graph showing measurement results of shock absorbing performance of each of shock absorbers according to Comparative Examples 1 to 3.
Figures 7, 8:
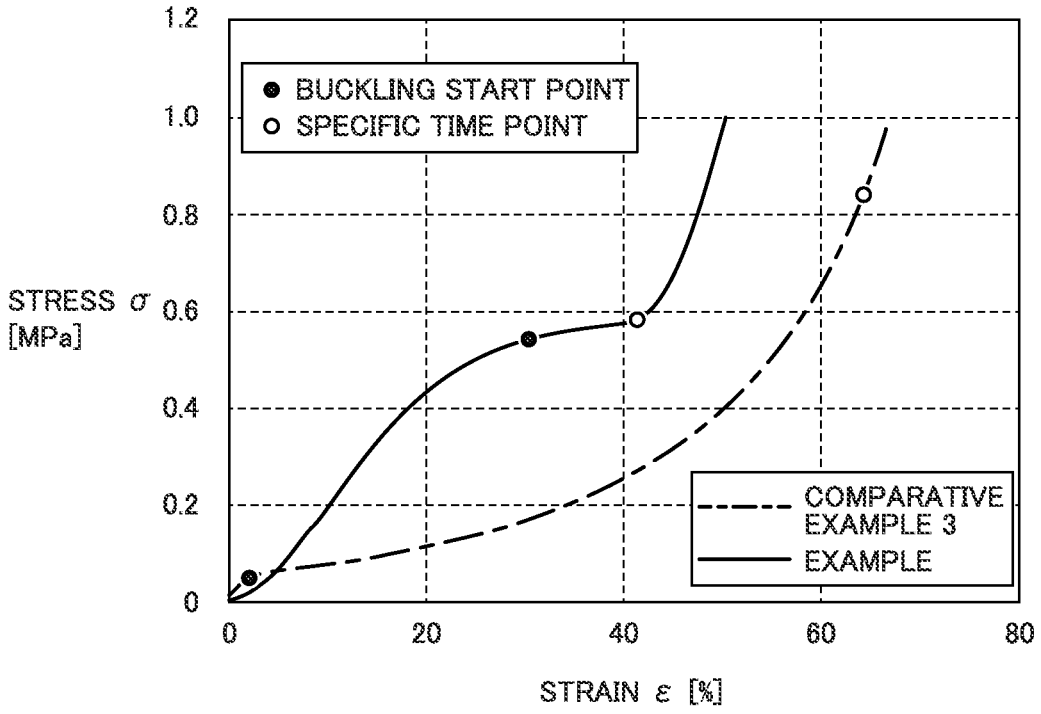
FIG. 7 is a table showing characteristics of the shock absorbers according to Comparative Examples 1 to 3.
FIG. 8 is a graph showing measurement results of shock absorbing performance of a shock absorber according to Example.

FIG. 6 is a graph showing measurement results of the shock absorbing performance of each of the shock absorbers according to Comparative Examples 1 to 3. FIG. 7 is a table showing the characteristics of the shock absorbers according to Comparative Examples 1 to 3.

As shown in FIG. 6, each of the stress-strain curves of the shock absorbers according to Comparative Examples 1 to 3 conformed to the stress-strain curve of the above-mentioned commonly-used shock absorber (see FIG. 5). In particular, in the case of the shock absorber according to Comparative Example 1, the loading process did not include a region where the stress hardly changed even when the strain increased, like a region included in the stress-strain curve of the shock absorber 1A.

On the other hand, in the case of the shock absorbers according to Comparative Examples 2 and 3, the loading process included a small region where the stress hardly changed even when the strain increased. However, the buckling start point of the shock absorber according to each of Comparative Examples 2 and 3 was out of both the required stress range and the required strain range mentioned above.

More specifically, as shown in FIG. 7, it was calculated that the buckling start point of the shock absorber according to Comparative Example 2 was located at a point at which the stress σ was 0.07 MPa and the strain E was 6.6%, and the buckling start point of the shock absorber according to Comparative Example 3 was located at a point at which the stress σ was 0.04 MPa and the strain E was 2.5%. The method of calculating the buckling start point will be described in Verification Test 2, which will be described later.

In this case, as shown in FIG. 7, the maximum stress $\sigma_{max}$ of the shock absorber according to each of Comparative Examples 1 to 3 was 0.84 MPa at the minimum and 0.94 MPa at the maximum, and the tangential elastic modulus of the shock absorber according to each of Comparative Examples 1 to 3 at a specific time point was 5.40 MPa at the minimum and 7.40 MPa at the maximum.

<Verification Test 2>

In Verification Test 2, a shock absorber similar in structure to the above-described shock absorber 1A was produced by injection molding actually using a mold, and the shock absorbing performance of this shock absorber was actually measured. One type of shock absorber according to Example was produced, and its stress-strain curve was obtained using Autograph AGX-50 kN manufactured by Shimadzu Corporation as a measuring device. As for the test conditions, the compression rate was set at 1%/s, and the maximum pressure was set at 1.00 MPa.

Figures 9, 10:
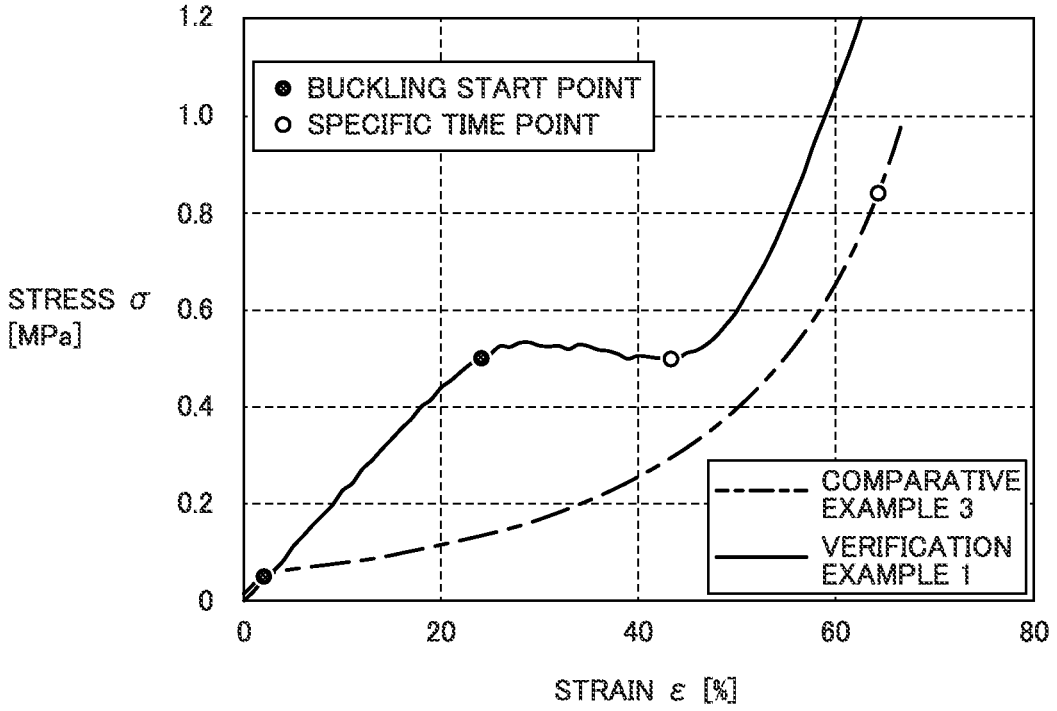
FIG. 9 is a table showing characteristics of the shock absorber according to Example.
FIG. 10 is a graph showing simulation results of shock absorbing performance of a shock absorber according to Verification Example 1.

FIG. 8 is a graph showing the measurement results of the shock absorbing performance of the shock absorber according to Example, and FIG. 9 is a table showing the characteristics of the shock absorber according to Example. In this case, for comparison, FIGS. 8 and 9 each additionally show the results of Comparative Example 3 in which it was confirmed that the highest shock absorbing performance was achieved in the above-described Verification Test 1.

As shown in FIG. 8, the stress-strain curve of the shock absorber according to Example conformed to the stress-strain curve of the shock absorber 1A (see FIG. 4). In other words, in the case of the shock absorber according to Example, the loading process included a region where the stress a hardly changed even when the strain c increased, like a region included in the stress-strain curve of the shock absorber 1A.

In this case, as shown in FIG. 9, the maximum stress $\sigma_{max}$ of the shock absorber according to Example was 0.59 MPa, and the tangential elastic modulus of the shock absorber according to this Example at the specific time point was 1.35 MPa.

The shock absorber according to the present Example was significantly lower in maximum stress $\sigma_{max}$ and tangential elastic modulus at the specific time point than the shock absorber according to Comparative Example 3. Thus, it was confirmed that the shock absorber 1A having the configuration as described above could achieve high shock absorbing performance.

In this case, as shown in FIGS. 8 and 9, the buckling start point was calculated from the stress-strain curve of the shock absorber according to Example. The buckling start point was calculated by the following method.

First, the tangential elastic modulus at each point is calculated by differentiating the stress a with respect to the strain ε based on the stress-strain curve. Then, the tangential elastic modulus obtained at 1% of the strain ε is defined as an initial elastic modulus, and the point at which the tangential elastic modulus equal to or less than ½ of the initial elastic modulus is obtained for the first time in the loading process is defined as a buckling start point. From the viewpoint of reducing errors, various filtering methods may be applied as required for calculating the buckling start point. The method similar to the above-mentioned method can be used also in the case of calculating the buckling start point from the stress-strain curve obtained by a simulation as will be described later.

As a result, it was calculated that the buckling start point of the shock absorber according to Example was located at a point at which the stress σ was 0.55 MPa and the strain ε was 31.0%. In this case, it was confirmed that the buckling start point of the shock absorber according to Comparative Example 3 was located at a point at which the stress σ was 0.04 MPa and the strain ε was 2.5% as described above, and thus, this buckling start point was out of both the required stress range and the required strain range (the same applies to the shock absorber according to Comparative Example 2), whereas the buckling start point of the shock absorber according to Example was within both the required stress range and the required strain range.

As shown in FIG. 9, it could also be confirmed that the specific gravity of the shock absorber according to Example was 0.280 g/cm$^3$, and thus the weight could be reduced to an extent comparable to the case of the specific gravity (0.259 g/cm$^3$) of the shock absorber according to Comparative Example 3. In other words, it was confirmed that the shock absorber 1A having the configuration as described above not only could achieve high shock absorbing performance but also could suppress an increase in weight.

<Verification Test 3>

In Verification Test 3, a simulation model approximately corresponding to the shock absorber according to the aforementioned Example was prepared as Verification Example 1, and subjected to a structural analysis using a finite element method (FEM), to thereby calculate a stress-strain curve of the shock absorber according to Verification Example 1 formed of the simulation model. Then, it was checked how degree the calculated stress-strain curve conforms to the stress-strain curve actually measured using the shock absorber according to Example. Note that the occupied volume ratio of the shock absorber according to Verification Example 1 is 25%, and the elastic modulus of the base material is 14 MPa.

Figures 11, 12:
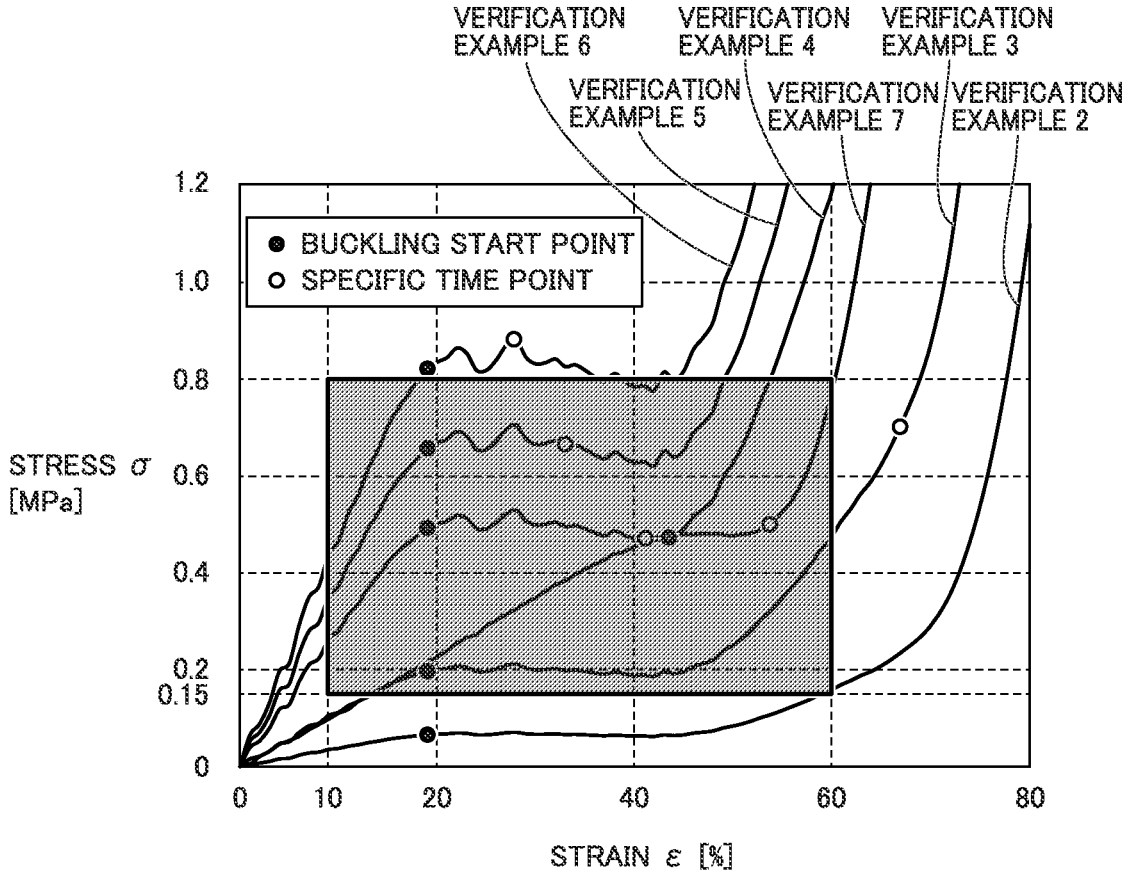
FIG. 11 is a table showing characteristics of the shock absorber according to Verification Example 1.
FIG. 12 is a graph showing simulation results of shock absorbing performance of each of shock absorbers according to Verification Examples 2 to 7.

FIG. 10 is a graph showing simulation results of the shock absorbing performance of the shock absorber according to Verification Example 1. FIG. 11 is a table showing characteristics of the shock absorber according to Verification Example 1. For comparison, FIGS. 10 and 11 each additionally show the results of Comparative Example 3 by which it was confirmed that the highest shock absorbing performance was achieved in the above-described Verification Test 1.

As shown in FIG. 10, the stress-strain curve of the shock absorber according to Verification Example 1 conformed to the stress-strain curve of the shock absorber 1A (see FIG. 4) described above. In other words, in the case of the shock absorber according to Verification Example 1, the loading process included a region where the stress σ hardly changed even when the strain ε increased, like a region included in the stress-strain curve of the shock absorber 1A.

In this case, as shown in FIG. 11, the maximum stress $\sigma_{max}$ of the shock absorber according to Verification Example 1 was 0.53 MPa, and the tangential elastic modulus of the shock absorber according to Verification Example 1 at a specific time point was −0.16 MPa. The shock absorber according to Verification Example 1 is coincident in maximum stress $\sigma_{max}$ and tangential elastic modulus at the specific time point with the shock absorber according to the above-described Example. Thus, it was confirmed that the simulation method performed in Verification Test 3 was an approximately appropriate method for predicting the maximum stress $\sigma_{max}$ and the tangential elastic modulus at the specific time point.

Further, as shown in FIG. 11, it was calculated that the buckling start point of the shock absorber according to Verification Example 1 was located at a point at which the stress σ was 0.50 MPa and the strain E was 24.0%. The buckling start point of the shock absorber according to Verification Example 1 also coincides with the buckling start point of the shock absorber according to the above-described Example. Thus, it was confirmed that the simulation method performed in Verification Test 3 was an approximately appropriate method for predicting the buckling start point.

<Verification Test 4>

In Verification Test 4, a plurality of simulation models of the shock absorbers basically similar in structure to the shock absorber 1A were prepared and subjected to a structural analysis using the above-mentioned finite element method (FEM), to thereby calculate the stress-strain curve, the maximum stress $\sigma_{max}$, the tangential elastic modulus at a specific time point, the buckling start point, and the like of each of the shock absorbers formed based on these simulation models. In this case, a total of six types of shock absorbers according to Verification Examples 2 to 7 were prepared based on the produced simulation models. Among them, the shock absorbers according to Verification Examples 2 to 6 are different only in elastic modulus of base material.

FIG. 12 is a graph showing simulation results of the shock absorbing performance of each of shock absorbers according to Verification Examples 2 to 7. FIG. 13 is a table showing characteristics of the shock absorbers according to Verification Examples 2 to 7.

As shown in FIGS. 12 and 13, the stress-strain curves of the shock absorbers according to Verification Examples 2 to 7 conformed to the stress-strain curve of the shock absorber 1A (see FIG. 4) described above. In other words, in the case of the shock absorbers according to Verification Examples 2 to 7, the loading process included a region where the stress σ hardly changed even when the strain ε increased, like a region included in the stress-strain curve of the shock absorber 1A.

However, in the case of the shock absorber according to Verification Example 2 in which the elastic modulus of base material was relatively small, the strain E at the buckling start point was 19.0%, whereas the stress σ at the buckling start point was 0.07 MPa. Thus, the buckling start point was out of the above-mentioned required stress range, and accordingly, the maximum stress $\sigma_{max}$ reached 1.67 MPa, and the tangential elastic modulus at the specific time point reached 30.07 MPa. Thus, it was confirmed that sufficient shock absorbing performance could not be achieved when this shock absorber was applied to a shoe sole.

Further, in the case of the shock absorber according to Verification Example 6 in which the elastic modulus of base material was relatively large, the strain E at the buckling start point was 19.0%, whereas the stress σ at the buckling start point was 0.82 MPa. Thus, the buckling start point was out of the above-mentioned required stress range, and accordingly, the maximum stress $\sigma_{max}$ reached 0.88 MPa. Thus, it was confirmed that sufficient shock absorbing performance could not be achieved when this shock absorber was applied to a shoe sole.

On the other hand, in the case of the shock absorbers according to Verification Examples 3 to 5 in which each elastic modulus of base material was within a range between the elastic modulus of the base material of the shock absorber according to Verification Example 2 and the elastic modulus of the base material of the shock absorber according to Verification Example 6, each of the strains c at the buckling start point was 19.0%, and the respective stresses σ at the buckling start point were 0.20 MPa, 0.49 MPa, and 0.66 MPa. Thus, the buckling start points were within both the required strain range and the required stress range, and accordingly, the respective maximum stresses $\sigma_{max}$ reached 0.70 MPa, 0.52 MPa, and 0.71 MPa, and the respective tangential elastic moduli at the corresponding specific time points were 4.49 MPa, −0.24 MPa, and −0.47 MPa. Consequently, it was confirmed that high shock absorbing performance could be achieved when each of these shock absorbers was applied to a shoe sole.

Further, in the case of the shock absorber according to Verification Example 7 in which the elastic modulus of base material was relatively small but the occupied volume ratio was relatively high, the strain ε at the buckling start point was 42.0%, and also the stress σ at the buckling start point was 0.47 MPa. Thus, the buckling start point was within both the required strain range and the required stress range, and accordingly, the maximum stress $\sigma_{max}$ reached 0.50 MPa, and the tangential elastic modulus at the specific time point reached 1.48 MPa. Consequently, it was confirmed that high shock absorbing performance could be achieved when this shock absorber was applied to a shoe sole.

<Summary of Verification Tests 1 to 4>

Based on the results of Verification Tests 1 to 4 as described above, it is understood that unconventionally high shock absorbing performance can be achieved by a shock absorber as described below. In this case, specifically, the shock absorber is configured to have a three-dimensional shape formed by a wall having an outer shape defined by a pair of parallel flat surfaces such that the shock absorber may buckle when it receives compressive force, and also configured to start buckling within the required strain range and the required stress range when a load is applied to the shock absorber in a gradually increasing manner. In addition, the maximum value of the stress occurring in the shock absorber from the start of application of the compressive force to the shock absorber until reaching the specific time point is set at the above-mentioned prescribed value or less, and the tangential elastic modulus of the shock absorber at the specific time point is set at the above-mentioned prescribed value or less. Thereby, unconventionally high shock absorbing performance as described above can be achieved. In order to facilitate understanding, in the graph shown in FIG. 12, the required strain range and the required stress range are shown in dark color.

In this case, the above-described shock absorber 1A has the unit structure body U configured by adding a thickness to each of divided structure units obtained by dividing a structure unit having the Kelvin structure into two in the height direction. In place of the structure unit having the Kelvin structure, a structure unit having another surface structure may be used.

For example, in the case of a shock absorber having a three-dimensional shape formed by a wall having an outer shape defined by a pair of parallel flat surfaces similarly to the aforementioned shock absorber 1A, other structure units such as an octet structure, a cubic structure, and a cubic-octet structure can be used in addition to the Kelvin structure.

Each of the structure units having the surface structures as described above is a structure unit formed of a plurality of flat surfaces disposed to intersect with each other and be hollow inside. This structure unit is divided into two in one of the orthogonal three-axis directions, and a thickness is added to each of the divided structure units to thereby form a shock absorber. Consequently, a shock absorber capable of achieving high shock absorbing performance can be obtained.

Shoe Sole and Shoe According to Embodiment, and Shoe Soles and Shoes According to First to Eleventh Modifications

Embodiment

Figure 14:
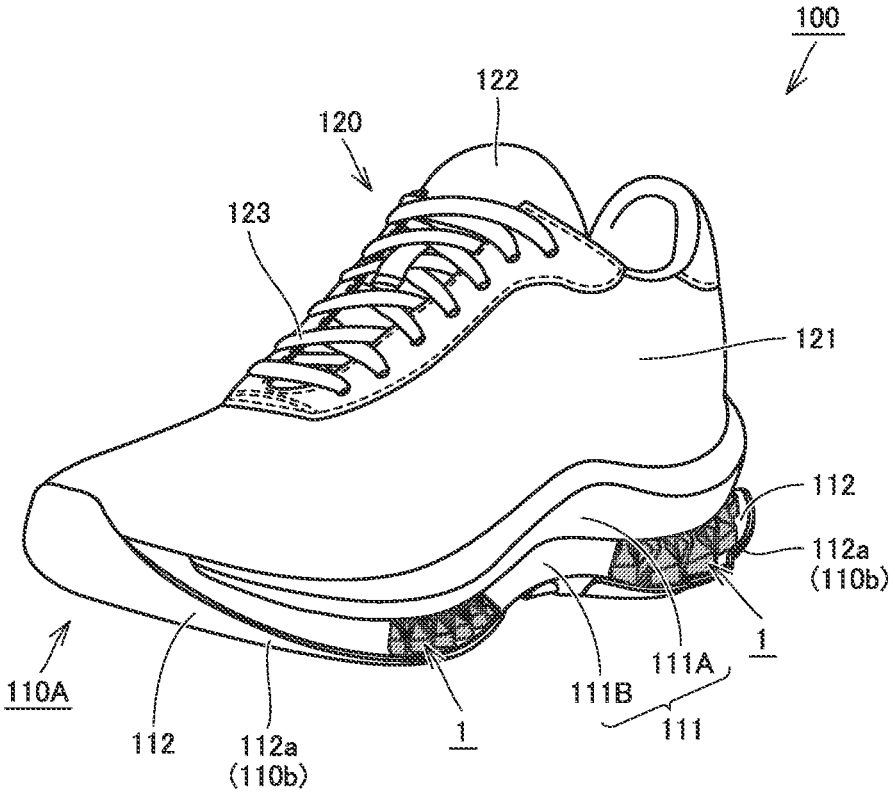
FIG. 14 is a perspective view of a shoe sole and a shoe according to an embodiment.
Figure 15:
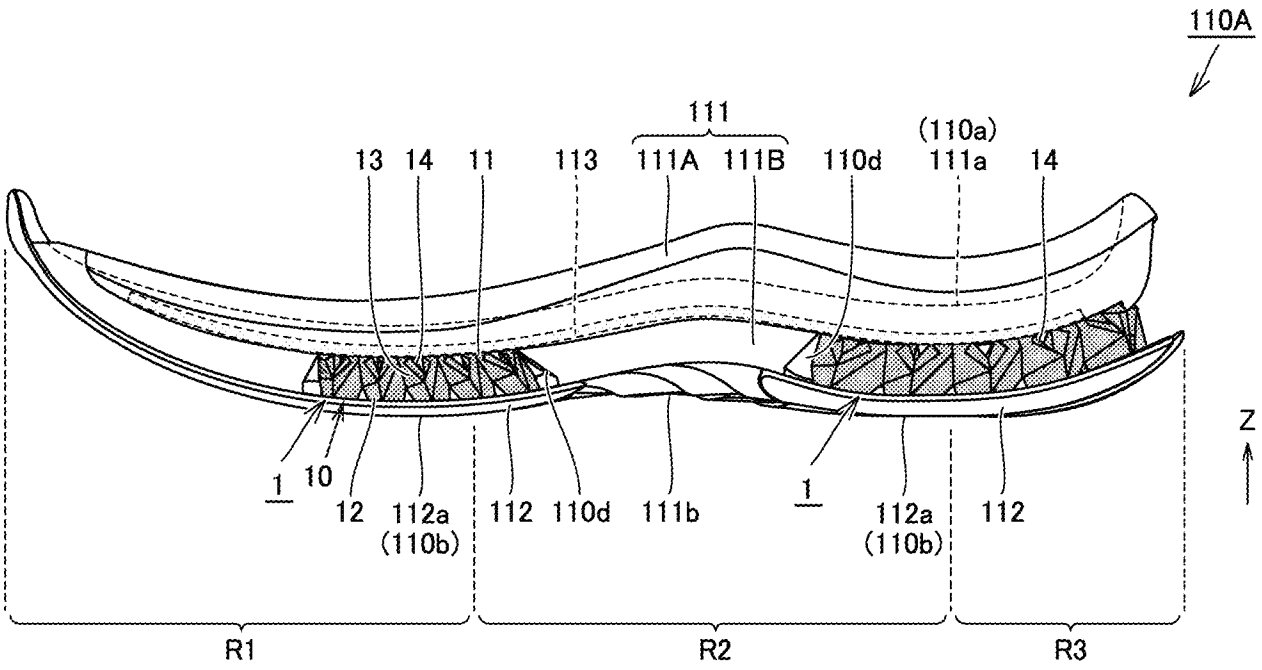
FIG. 15 is a side view of the shoe sole shown in FIG. 14 when viewed from a lateral foot side.
Figure 16:
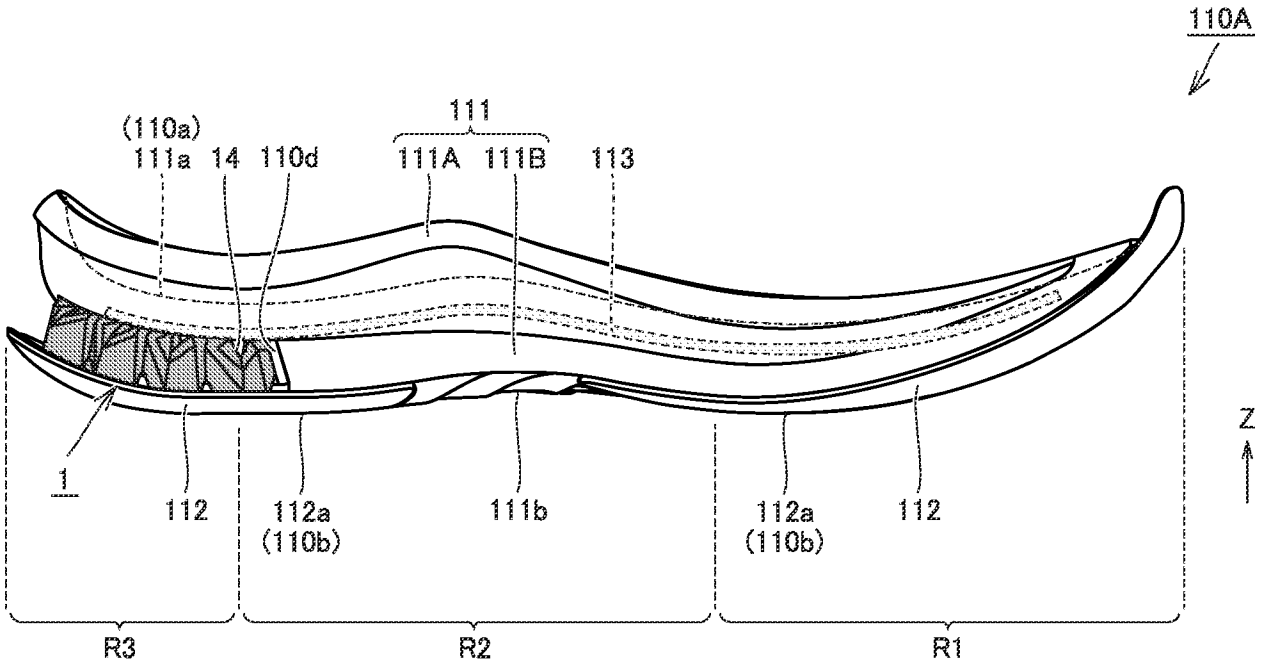
FIG. 16 is a side view of the shoe sole shown in FIG. 14 when viewed from a medial foot side.
Figure 17:
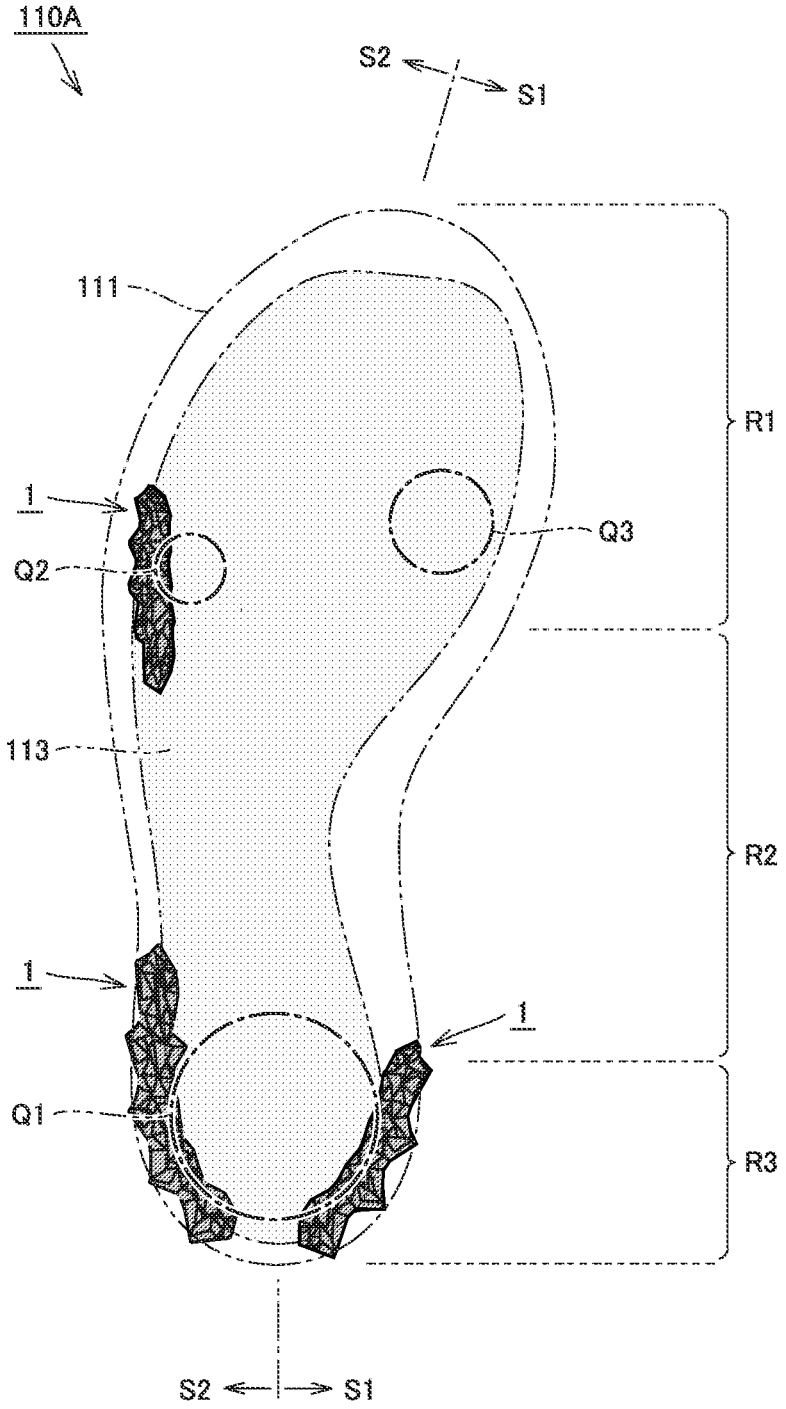
FIG. 17 is a schematic plan view of the shoe sole shown in FIG. 14.
Figure 18:
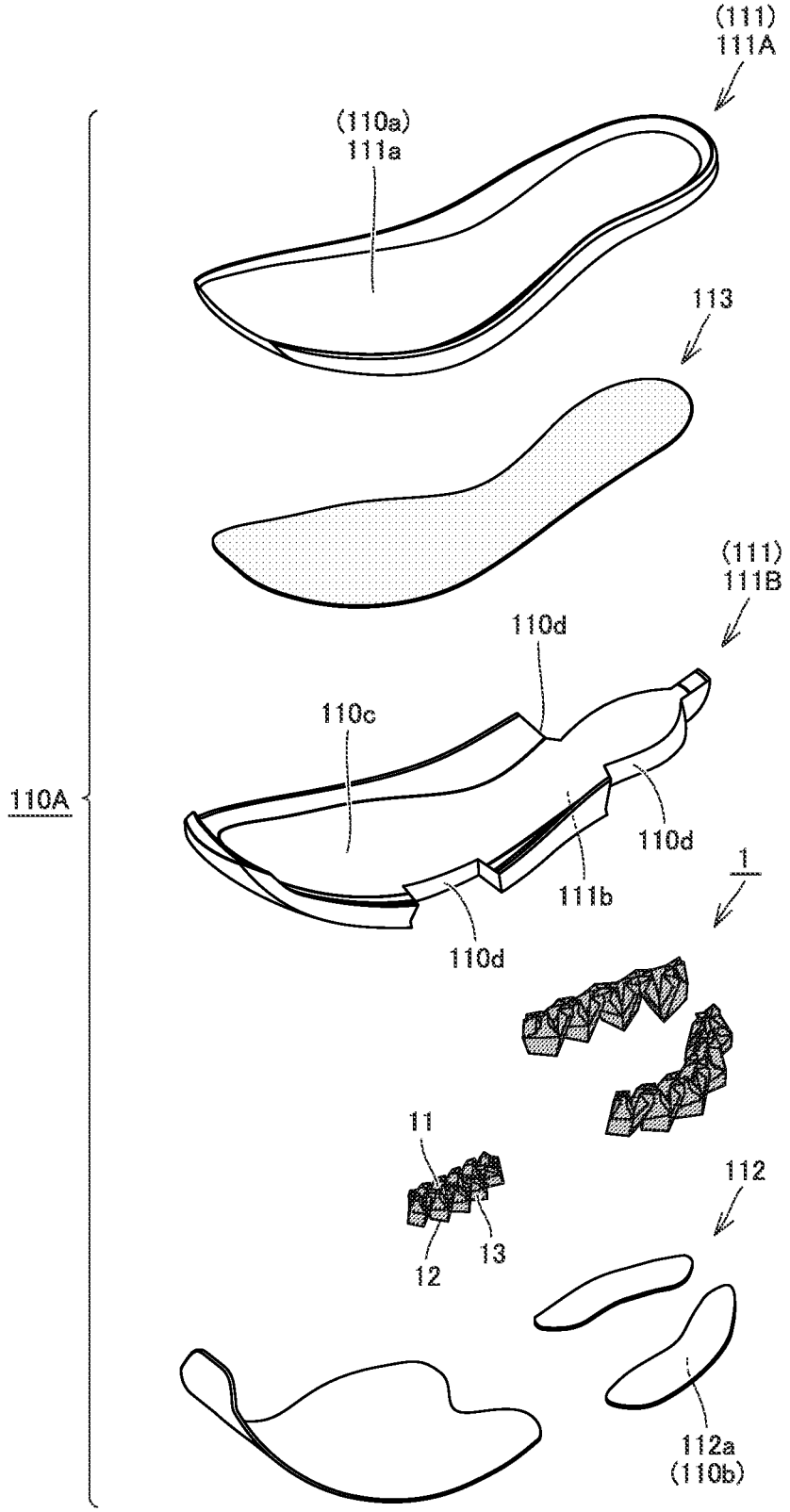
FIG. 18 is an exploded perspective view of the shoe sole shown in FIG. 14.

FIG. 14 is a perspective view of a shoe sole and a shoe according to an embodiment. FIGS. 15 and 16 are side views of the shoe sole shown in FIG. 14 when viewed from a lateral foot side and a medial foot side, respectively. FIG. 17 is a schematic plan view of the shoe sole shown in FIG. 14. FIG. 18 is an exploded perspective view of the shoe sole. Referring to FIGS. 14 to 18, the following describes a shoe sole 110A according to the present embodiment and a shoe 100 including the shoe sole 110A.

As shown in FIG. 14, the shoe 100 includes the shoe sole 110A and an upper 120. The shoe sole 110A is a member covering a sole of a foot and having a substantially flat shape. The upper 120 has a shape at least covering the entire portion of the top of the foot inserted into a shoe and is located above the shoe sole 110A.

The upper 120 includes an upper body 121, a shoe tongue 122, and a shoelace 123. Each of the shoe tongue 122 and the shoelace 123 is fixed or attached to the upper body 121.

The upper portion of the upper body 121 is provided with an upper opening through which the upper portion of an ankle and a part of the top of the foot are exposed. Further, the lower portion of the upper body 121 is provided with, as one example, a lower opening covered by the shoe sole 110A and, as another example, a bottom portion formed by stitching the lower end of the upper body 121 with French seam.

The shoe tongue 122 is fixed to the upper body 121 by sewing, welding, bonding, or a combination thereof so as to cover a portion of the upper opening provided in the upper body 121 through which a part of the top of a foot is exposed. For the upper body 121 and the shoe tongue 122, for example, woven fabric, knitted fabric, nonwoven fabric, synthetic leather, resin, or the like may be used. For shoes particularly required to be air permeable and lightweight, a double raschel warp knitted fabric with a polyester yarn knitted therein may be used.

The shoelace 123 is formed of a member in the form of a string for pulling together, in the foot width direction, portions of a peripheral edge of the upper opening which is provided in the upper body 121 and through which a part of the top of a foot is exposed. The shoelace 123 is passed through a plurality of holes provided along the peripheral edge of the upper opening. When the shoelace 123 is tightened in the state in which a foot is inserted into the upper body 121, the upper body 121 can be brought into close contact with the foot.

As shown in FIGS. 14 to 18, the shoe sole 110A includes: a midsole 111 and an outsole 112 as a shoe sole body; a highly rigid plate 113 (see FIGS. 15 to 18); and a shock absorber 1. The midsole 111, the outsole 112, the highly rigid plate 113, and the shock absorber 1 are assembled and thereby integrated with each other, so that the shoe sole 110A is entirely formed in an approximately flat shape having a top surface 110*a* and a bottom surface 110*b*.

In this case, the shock absorber 1 provided in the shoe sole 110A is similar in basic structure to the shock absorber 1A described above and is shown in dark color in the figures in order to facilitate understanding. By providing this shock absorber 1 in the shoe sole 110A, the shoe sole and the shoe capable of achieving unconventionally high shock absorbing performance can be obtained, which will be described later in detail.

The midsole 111 is located above the outsole 112. Thereby, the top surface 110*a* of the shoe sole 110A is defined by the midsole 111, and the bottom surface 110*b* of the shoe sole 110A is defined by the outsole 112. The highly rigid plate 113 is embedded in the midsole 111 and thereby fixed to the midsole 111. Further, the shock absorber 1 is accommodated in a cutout portion 110*d* (see FIGS. 15, 16, and 18, as will be described later) provided in the midsole 111 and thereby embedded in the midsole 111.

As shown in FIGS. 15 to 17, the shoe sole 110A is divided into: a forefoot portion R1 that supports a toe portion and a ball portion of the wearer's foot; a midfoot portion R2 that supports an arch portion of the wearer's foot; and a rearfoot portion R3 that supports a heel portion of the wearer's foot, in a front-rear direction (the left-right direction in FIGS. 15 and 16 and the up-down direction in FIG. 17) that corresponds to a foot length direction of the wearer's foot in a plan view.

In this case, with reference to the front end of the shoe sole 110A, a first boundary position is defined at a position located at 40% of the dimension of the shoe sole 110A from the front end in the front-rear direction, and a second boundary position is defined at a position located at 80% of the dimension of the shoe sole 110A from the front end in the front-rear direction. In this case, the forefoot portion R1 corresponds to a portion included between the front end and the first boundary position in the front-rear direction, the midfoot portion R2 corresponds to a portion included between the first boundary position and the second boundary position in the front-rear direction, and the rearfoot portion R3 corresponds to a portion included between the second boundary position and the rear end of the shoe sole in the front-rear direction.

Further, as shown in FIG. 17, the shoe sole 110A is divided into a portion on the medial foot side (a portion on the S1 side shown in the figure) and a portion on the lateral foot side (a portion on the S2 side shown in the figure) in the left-right direction (the left-right direction in the figure) corresponding to the foot width direction of the wearer's foot in a plan view. In this case, the portion on the medial foot side corresponds to the medial side of the foot in anatomical position (i.e., the side close to the midline) and the portion on the lateral foot side is opposite to the medial side of the foot in anatomical position (i.e., the side away from the midline).

As shown in FIGS. 14 to 18, the midsole 111 extends in the front-rear direction from the forefoot portion R1 through the midfoot portion R2 to the rearfoot portion R3. The midsole 111 has an upper surface 111*a*, a lower surface 111*b*, and a side surface connecting the upper surface 111*a* and the lower surface 111*b*, and forms an upper-side portion of the shoe sole 110A. The upper surface 111*a* of the midsole 111 forms the top surface 110*a* of the shoe sole 110A as described above, and is bonded to the upper 120, for example, with an adhesive or the like.

In this case, as shown particularly in FIG. 18, the midsole 111 is formed of two members including an upper midsole portion 111A and a lower midsole portion 111B. The upper midsole portion 111A defines the top surface 110*a* of the shoe sole 110A (i.e., the upper surface 111*a* of the midsole 111), and has a substantially plate-like flat shape. On the other hand, the lower midsole portion 111B is located below the upper midsole portion 111A. The lower midsole portion 111B defines the lower surface 111*b* of the midsole 111, and has a substantially plate-like and relatively thick shape.

An upper surface of the upper midsole portion 111A that defines the top surface 110*a* of the shoe sole 110A has a peripheral edge portion shaped to protrude more than the surrounding area. Thereby, the upper surface of the upper midsole portion 111A is provided with a recessed portion in which the upper 120 is received. The portion of the upper surface of the upper midsole portion 111A that excludes the peripheral edge portion and corresponds to the bottom surface of this recessed portion is shaped to have a smooth curved surface so as to be fitted to the shape of the sole of the wearer's foot.

The upper surface of the lower midsole portion 111B is provided with a recessed portion 110*c* that extends from the forefoot portion R1 to the rearfoot portion R3. The recessed portion 110*c* serves to accommodate the highly rigid plate 113, and is shaped to conform to the outer shape of the highly rigid plate 113.

A plurality of cutout portions 110*d* are provided at prescribed positions on the peripheral edge of the lower midsole portion 111B. Specifically, the cutout portions 110*d* are respectively provided in: a portion extending between a position closer to the rear end of the midfoot portion R2 on the lateral foot side and a position of the rearfoot portion R3 on the lateral foot side in the peripheral edge of the lower midsole portion 111B; a portion extending between a position closer to the rear end of the midfoot portion R2 on the medial foot side and a position of the rearfoot portion R3 on the medial foot side in the peripheral edge of the lower midsole portion 111B; and a portion extending between a position closer to the rear end of the forefoot portion R1 on the lateral foot side and a position closer to the front end of the midfoot portion R2 on the lateral foot side in the peripheral edge of the lower midsole portion 111B.

As described above, the plurality of cutout portions 110*d* serve to accommodate the shock absorber 1, and are provided to reach the upper surface, the lower surface, and the side surface of the lower midsole portion 111B. Thereby, as will be described later, the highly rigid plate 113 accommodated in the recessed portion 110*c* and the shock absorber 1 accommodated in the cutout portion 110*d* can be disposed to directly face each other without having the midsole 111 interposed therebetween. Also, the outsole 112 covering the lower surface 111*b* of the midsole 111 and the shock absorber 1 accommodated in the cutout portion 110*d* can be disposed to directly face each other without having the midsole 111 interposed therebetween. Further, the shock absorber 1 can be exposed on the circumferential surface of the midsole 111.

The midsole 111 is made of a material lower in rigidity than the material of the shock absorber 1. The midsole 111 is preferably excellent in shock absorbing performance while having proper strength. For this purpose, the midsole 111 can be formed of a member, for example, made of resin or rubber, and may be particularly suitably formed of a foam material or a non-foam material such as a polyolefin resin, ethylene-vinyl acetate copolymer (EVA), polyamide-based thermoplastic elastomer (TPA, TPAE), thermoplastic polyurethane (TPU), polyester-based thermoplastic elastomer (TPEE), and the like.

Note that the upper midsole portion 111A and the lower midsole portion 111B are fixed, for example, by bonding with an adhesive or the like while the upper midsole portion 111A and the lower midsole portion 111B are superposed on each other in the state in which the highly rigid plate 113 is accommodated in the recessed portion 110*c* provided in the lower midsole portion 111B.

As shown in FIGS. 14 to 18, the outsole 112 extends in the front-rear direction from the forefoot portion R1 through the midfoot portion R2 to the rearfoot portion R3. The outsole 112 may be formed of a single member or may be divided into a plurality of members as shown in FIG. 18.

The outsole 112 has a relatively thin sheet-like shape and has an upper surface and a lower surface. The outsole 112 forms a lower-side portion of the shoe sole 110A and has the lower surface defining the bottom surface 10*b* of the shoe sole 110A. The outsole 112 is disposed to cover the shock absorber 1 accommodated in the cutout portion 110*d* of the midsole 111 and has the upper surface bonded to the lower surface 111*b* of the midsole 111 and the lower surface of the shock absorber 1, for example, with an adhesive or the like. Note that the lower surface of the outsole 112 that defines the bottom surface 110*b* of the shoe sole 110A is configured as a ground contact surface 112*a*.

The outsole 112 is preferably excellent in wear resistance and grip performance. From this viewpoint, the outsole 112 may be made of rubber, for example. Note that a tread pattern may be provided on the ground contact surface 112*a* corresponding to the lower surface of the outsole 112 for the purpose of enhancing the grip performance.

As shown in FIGS. 15 to 18, the highly rigid plate 113 is formed of a single member and extends in the front-rear direction (i.e., the direction intersecting with the ground contact surface 112*a* that corresponds to the bottom surface 110*b* of the shoe sole 110A) so as to extend from the forefoot portion R1 through the midfoot portion R2 to the rearfoot portion R3. More specifically, the highly rigid plate 113 is disposed in a portion of the forefoot portion R1 excluding the front end portion and a portion of the rearfoot portion R3 excluding the rear end portion in the front-rear direction of the shoe sole 110A while extending across the portion on the medial foot side (the portion on the S1 side) and the portion on the lateral foot side (the portion on the S2 side) in the left-right direction of the shoe sole 110A. In order to facilitate understanding, the highly rigid plate 113 is shown in light color in FIGS. 15, 16 and 18, and the region where the highly rigid plate 113 is disposed is shown in light color in FIG. 17.

The highly rigid plate 113 is entirely formed of a plate-like member, and embedded in the midsole 111 and thereby fixed to the midsole 111 as described above. More specifically, the highly rigid plate 113 is accommodated in the recessed portion 110*c* provided in the upper surface of the lower midsole portion 111B as described above, and thereby, is sandwiched between the upper midsole portion 111A and the lower midsole portion 111B, and thus, embedded in the midsole 111.

In this case, examples of the specific method of embedding the highly rigid plate 113 in the midsole 111 may include, for example, a method of inserting the highly rigid plate 113 during cast molding or injection molding of the midsole 111, in addition to the above-described method of inserting the highly rigid plate 113 to be sandwiched between two divided upper and lower parts of the midsole 111 during bonding.

The highly rigid plate 113 is made of a material higher in rigidity than the material of the midsole 111. The material of the highly rigid plate 113 is not particularly limited, but the highly rigid plate 113 may be made, for example, suitably using reinforcing fibers including: fiber-reinforced resin formed using carbon fibers, glass fibers, aramid fibers, Dyneema® fibers, Zylon® fibers, boron fibers, or the like; and non-fiber-reinforced resin made of a polymer resin such as urethane-based thermoplastic elastomer (TPU) or amide-based thermoplastic elastomer (TPA).

As shown in FIGS. 15 to 18, the shock absorber 1 is similar in basic structure to the shock absorber 1A as described above, and more specifically, the unit structure body U is formed by adding a thickness to each of divided structure units obtained by dividing a structure unit having the Kelvin structure into two in the height direction.

In this case, for providing the shock absorber 1 in the shoe sole 110A, the shock absorber 1 is configured such that its shape (for example, the outer shape or the like of the unit structure body U in a plan view as shown particularly in FIG. 17) is slightly deformed while maintaining the above-mentioned basic structure of the shock absorber 1A. Except for the above-described points, the shock absorber 1 is the same as the above-mentioned shock absorber 1A.

The shock absorber 1 is accommodated in the cutout portion 110*d* provided in the lower midsole portion 111B, and is disposed such that its height direction (the Z direction shown in the figure) corresponds to a normal direction to the ground contact surface 112*a* that is the bottom surface 110*b* of the shoe sole 110A.

As described above, the shock absorber 1 accommodated in the cutout portion 110*d* faces the highly rigid plate 113. Thus, the upper wall portion 11 of the shock absorber 1 is bonded to the lower surface of the highly rigid plate 113, for example, with an adhesive or the like, so that the shock absorber 1 is fixed to the highly rigid plate 113.

On the other hand, as described above, the lower surface of the shock absorber 1 accommodated in the cutout portion 110*d* faces the outsole 112, and the lower wall portion 12 of the shock absorber 1 is bonded to the upper surface of the outsole 112, for example, with an adhesive or the like, so that the shock absorber 1 is fixed to the outsole 112.

In other words, the shock absorber 1 is disposed such that its upper surface reaches the highly rigid plate 113 and its lower surface reaches the outsole 112, and thereby, the shock absorber 1 is sandwiched and held between the highly rigid plate 113 and the outsole 112.

As described above, the cutout portion 110*d* in which the shock absorber 1 is accommodated reaches the side surface of the midsole 111. Accordingly, the shock absorber 1 is exposed to the outside, and due to the structure of the shock absorber 1, an opened portion 14 (see FIGS. 15 and 16) to be provided on the side portion of the shock absorber 1 is also located to be exposed to the outside.

In this case, as described above particularly with reference to FIG. 17, a total of three shock absorbers 1 are disposed respectively in: a portion extending between the position closer to the rear end of the midfoot portion R2 on the lateral foot side and the position of the rearfoot portion R3 on the lateral foot side in the peripheral edge of the midsole 111; a portion extending between the position closer to the rear end of the midfoot portion R2 on the medial foot side and the position of the rearfoot portion R3 on the medial foot side in the peripheral edge of the midsole 111; and a portion extending between the position closer to the rear end of the forefoot portion R1 on the lateral foot side and the position closer to the front end of the midfoot portion R2 on the lateral foot side in the peripheral edge of the midsole 111. Among these shock absorbers 1, two shock absorbers 1 disposed in a portion extending across the midfoot portion R2 and the rearfoot portion R3 are located along a portion Q1 that supports the heel of the wearer's foot, and one shock absorber 1 disposed in a portion extending across the forefoot portion R1 and the midfoot portion R2 is located along a portion Q2 that supports the hypothenar of the wearer's foot.

By the configuration as described above, the shock absorber 1 is to be disposed in each of: the portion Q1 that supports the heel of the wearer's foot as a portion to which the highest load is applied during the foot landing action; and the portion Q2 that supports the hypothenar of the wearer's foot as a portion to which a relatively high load is applied during the foot landing action. Thereby, a shoe sole and a shoe that are capable of effectively achieving high shock absorbing performance can be obtained.

In this case, due to the structure of the shock absorber 1, the outer shape of the shock absorber 1 is basically the same even when the shock absorber 1 is turned upside down. However, in the state in which the shock absorber 1 is turned upside down, the protrusions and the recesses appearing in the surface of the shock absorber 1 are displaced in position. Thus, the top side and the bottom side of the shock absorber 1 need to be set in a manufacturing process.

At this time, in order to achieve higher shock absorbing performance, it is preferable that the upper wall portions 11 of an appropriate number of shock absorbers 1 are located at positions corresponding to the portion Q1 that supports the heel of the wearer's foot and the portion Q2 that supports the hypothenar of the wearer's foot.

According to the shoe sole 110A of the present embodiment and the shoe 100 including the shoe sole 110A as described above, based on the high shock absorbing performance of the shock absorber 1, the stress occurring in the shoe sole 110A at the time point when the strain energy accumulated in the shoe sole 110A during the foot landing action becomes maximum can be suppressed to be smaller. Therefore, a shoe sole dramatically enhanced in shock absorbing performance and a shoe including the shoe sole can be obtained.

First to Seventh Modifications

FIGS. 19 to 25 are schematic plan views of shoe soles respectively according to the first to seventh modifications. With reference to FIGS. 19 to 25, the following describes shoe soles 110B to 110H according to the first to seventh modifications based on the above-described embodiment. Each of the shoe soles 110B to 110H according to the first to seventh modifications is provided in the shoe 100 in place of the shoe sole 110A according to the above-described embodiment.

As shown in FIGS. 19 to 25, the shoe soles 110B to 110H according to the first to seventh modifications are different in configuration from the shoe sole 110A according to the above-described embodiment only in arrangement position of the shock absorber 1 in a plan view. In FIGS. 19 to 25, without representing the specific shape of the shock absorber 1 for convenience of illustration, the region where the shock absorber 1 is disposed is shown in dark color while the region where the highly rigid plate 113 is disposed is shown in light color.

Figure 19:
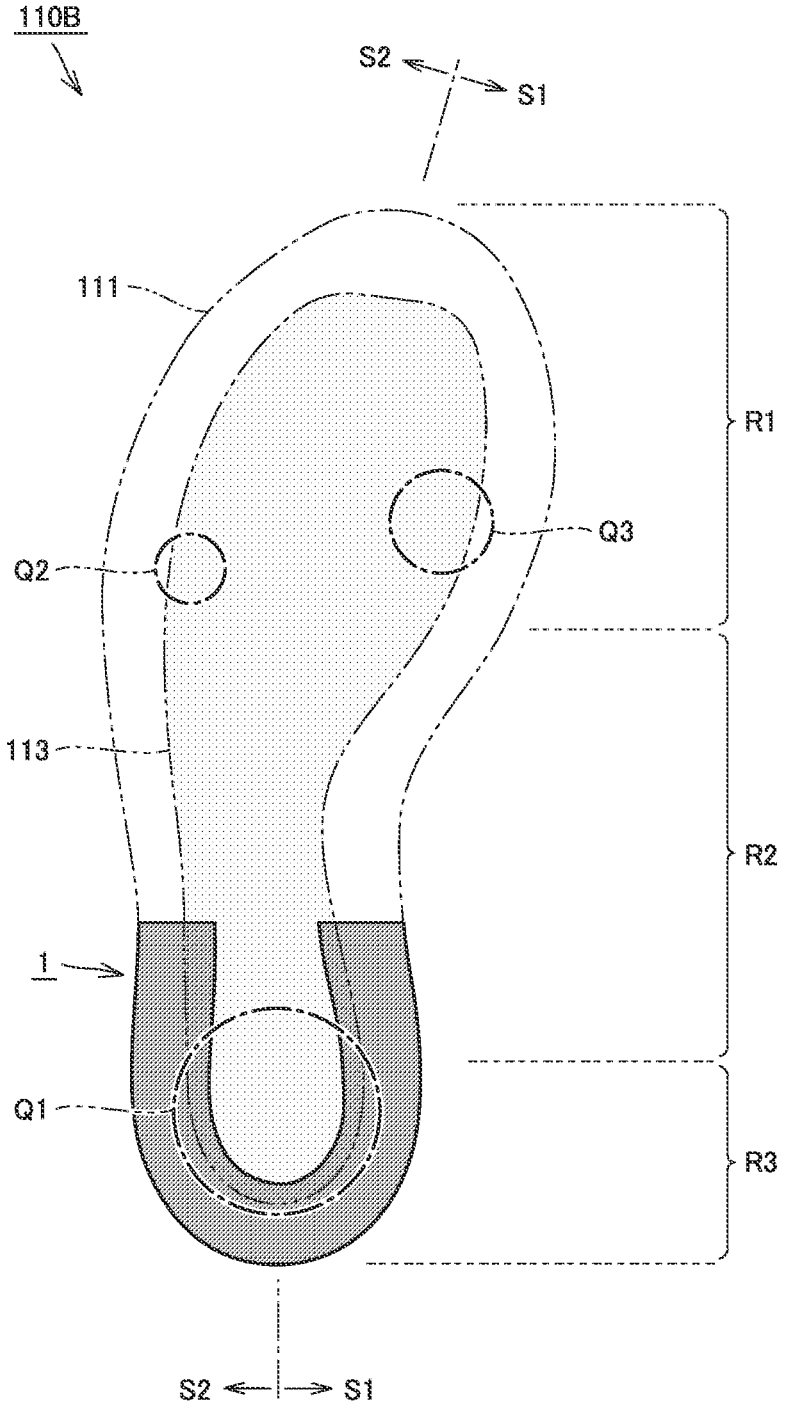
FIG. 19 is a schematic plan view of a shoe sole according to a first modification.

As shown in FIG. 19, in the shoe sole 110B according to the first modification, only one shock absorber 1 is disposed in a portion located along the peripheral edge of the midsole 111 and extending across: the position closer to the rear end of the midfoot portion R2 on the lateral foot side; the position of the rearfoot portion R3 on the lateral foot side; the position at the rear end of the rearfoot portion R3; the position of the rearfoot portion R3 on the medial foot side; and the position closer to the rear end of the midfoot portion R2 on the medial foot side. Thereby, the shock absorber 1 is located along the portion Q1 that supports the heel of the wearer's foot.

Also in the configuration as described above, the shock absorber 1 is to be disposed in the portion Q1 that supports the heel of the wearer's foot as a portion to which the highest load is applied during the foot landing action. Therefore, a shoe sole and a shoe that are capable of effectively achieving high shock absorbing performance can be obtained.

Figure 20:
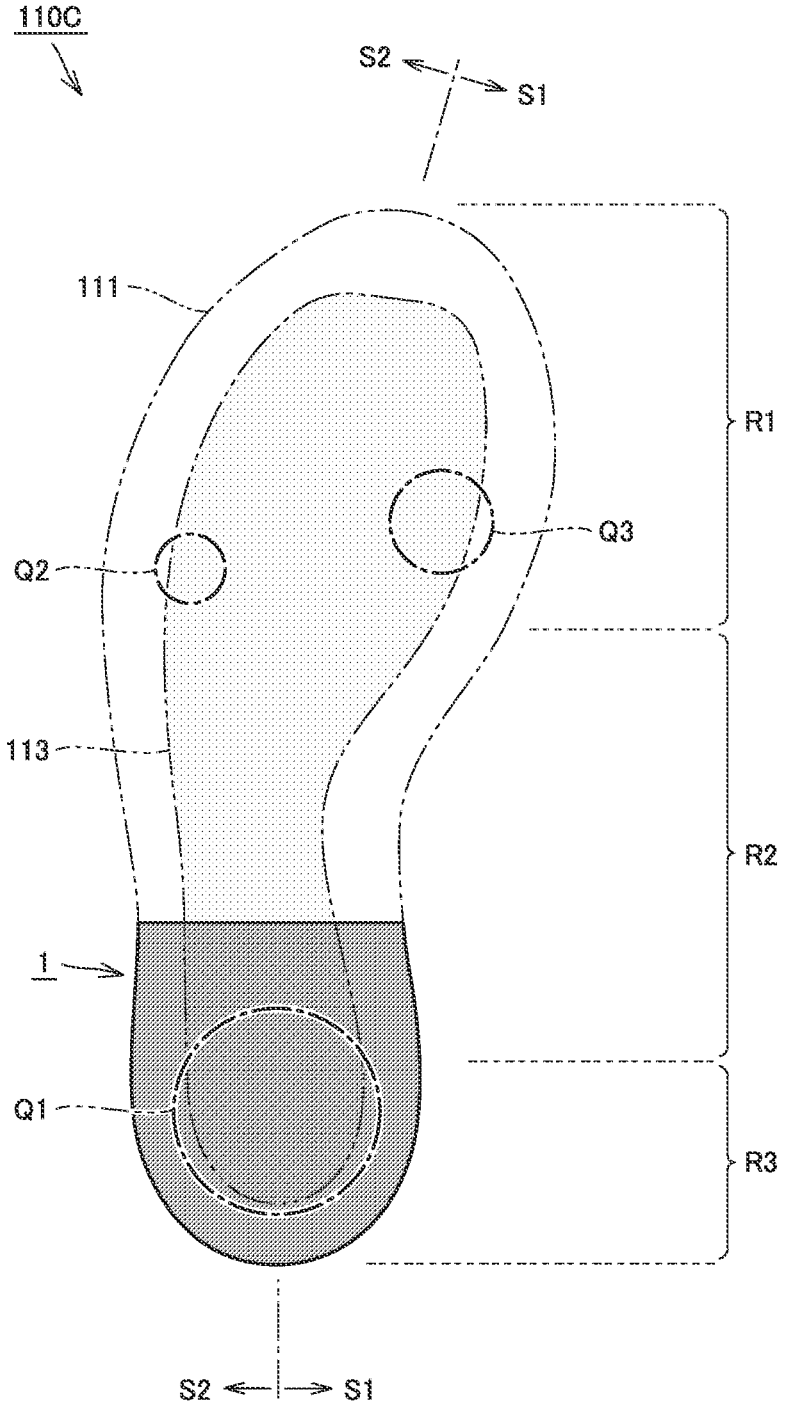
FIG. 20 is a schematic plan view of a shoe sole according to a second modification.

As shown in FIG. 20, in the shoe sole 110C according to the second modification, only one shock absorber 1 is disposed in a portion extending across the rear end portion of the midfoot portion R2 and the rearfoot portion R3 in the midsole 111. Thereby, the shock absorber 1 is located to completely overlap with the portion Q1 that supports the heel of the wearer's foot.

Also in the configuration as described above, the shock absorber 1 is to be disposed in the portion Q1 that supports the heel of the wearer's foot as a portion to which the highest load is applied during the foot landing action. Therefore, a shoe sole and a shoe that are capable of effectively achieving high shock absorbing performance can be obtained.

Figure 21:
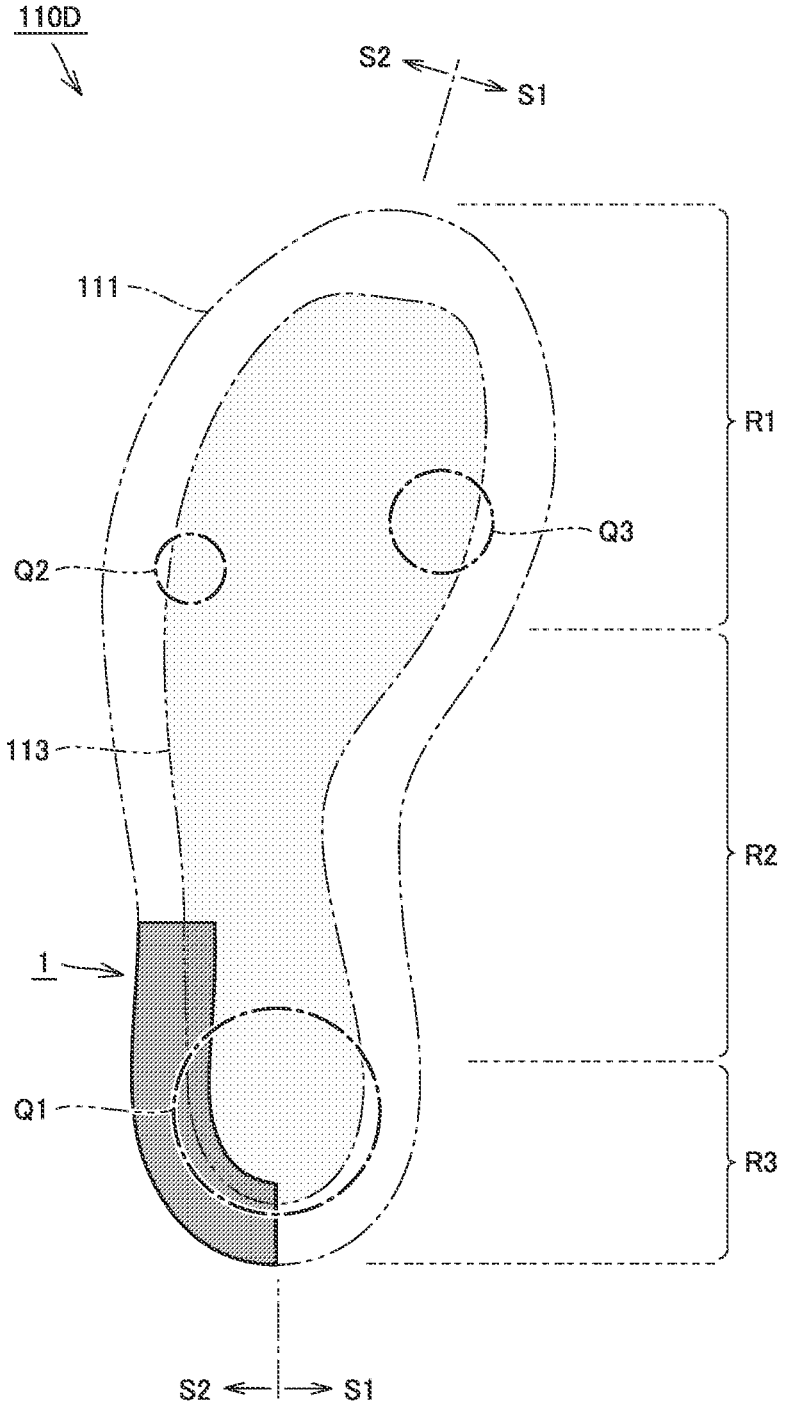
FIG. 21 is a schematic plan view of a shoe sole according to a third modification.

As shown in FIG. 21, in the shoe sole 110D according to the third modification, only one shock absorber 1 is disposed in a portion located along the peripheral edge of the midsole 111 and extending across the position closer to the rear end of the midfoot portion R2 on the lateral foot side and the position of the rearfoot portion R3 on the lateral foot side. Thereby, the shock absorber 1 is located along the portion Q1 that supports the heel of the wearer's foot.

Also in the configuration as described above, the shock absorber 1 is to be disposed in the portion Q1 that supports the heel of the wearer's foot as a portion to which the highest load is applied during the foot landing action. Therefore, a shoe sole and a shoe that are capable of effectively achieving high shock absorbing performance can be obtained.

Figure 22:
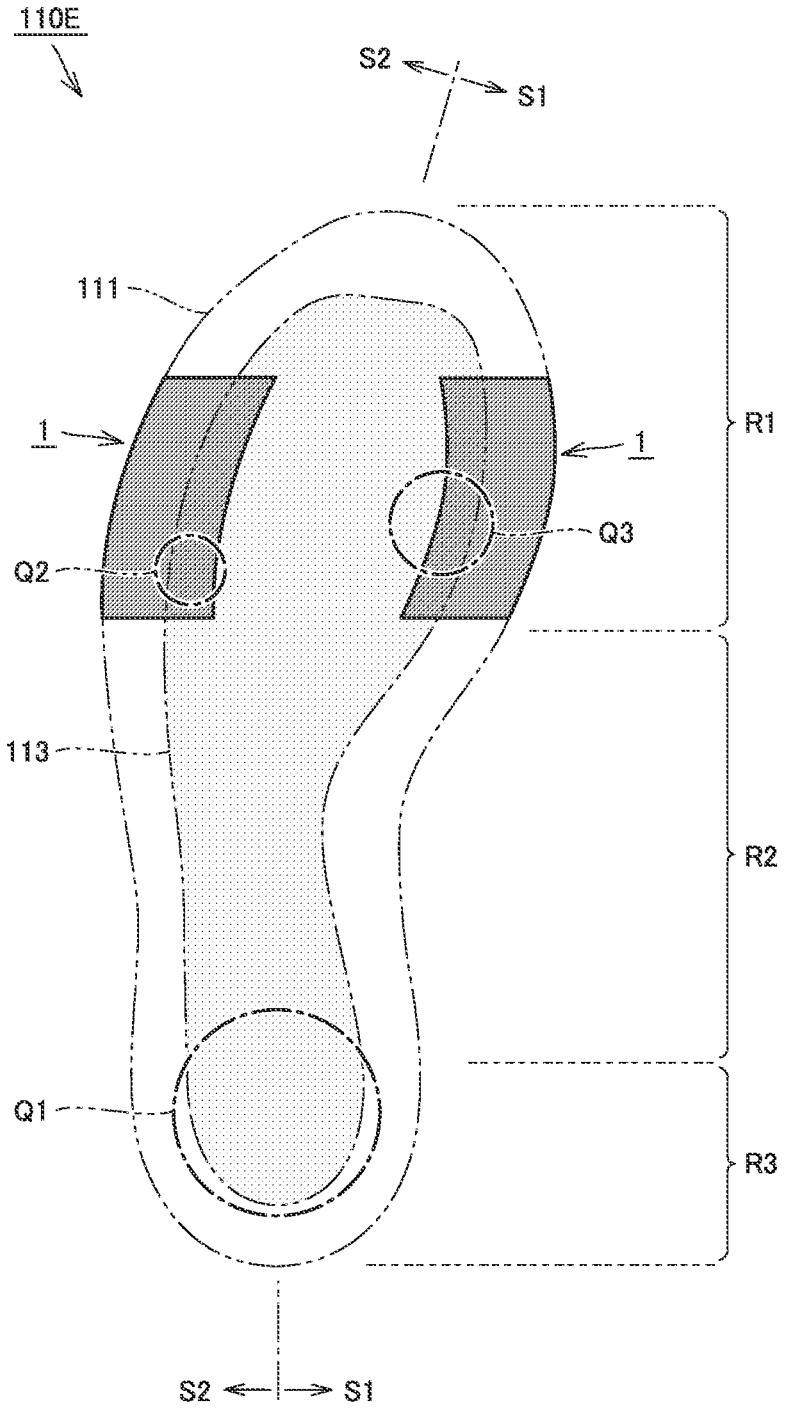
FIG. 22 is a schematic plan view of a shoe sole according to a fourth modification.

As shown in FIG. 22, in the shoe sole 110E according to the fourth modification, a total of two shock absorbers 1 are disposed along the peripheral edge of the midsole 111 and located at a position closer to the rear end of the forefoot portion R1 on the lateral foot side and at a position closer to the rear end of the forefoot portion R1 on the medial foot side. Thereby, the shock absorber 1 disposed at a position closer to the rear end of the forefoot portion R1 on the lateral foot side is located along the portion Q2 that supports the hypothenar of the wearer's foot, and the shock absorber 1 disposed at a position closer to the rear end of the forefoot portion R1 on the medial foot side is located along a portion Q3 that supports the ball of the wearer's foot.

Also in the configuration as described above, the shock absorber 1 is to be disposed in the portions Q2 and Q3 that support the hypothenar and the ball, respectively, of the wearer's foot as portions to which relatively high load is applied during the foot landing action. Therefore, a shoe sole and a shoe that are capable of effectively achieving high shock absorbing performance can be obtained.

Figure 23:
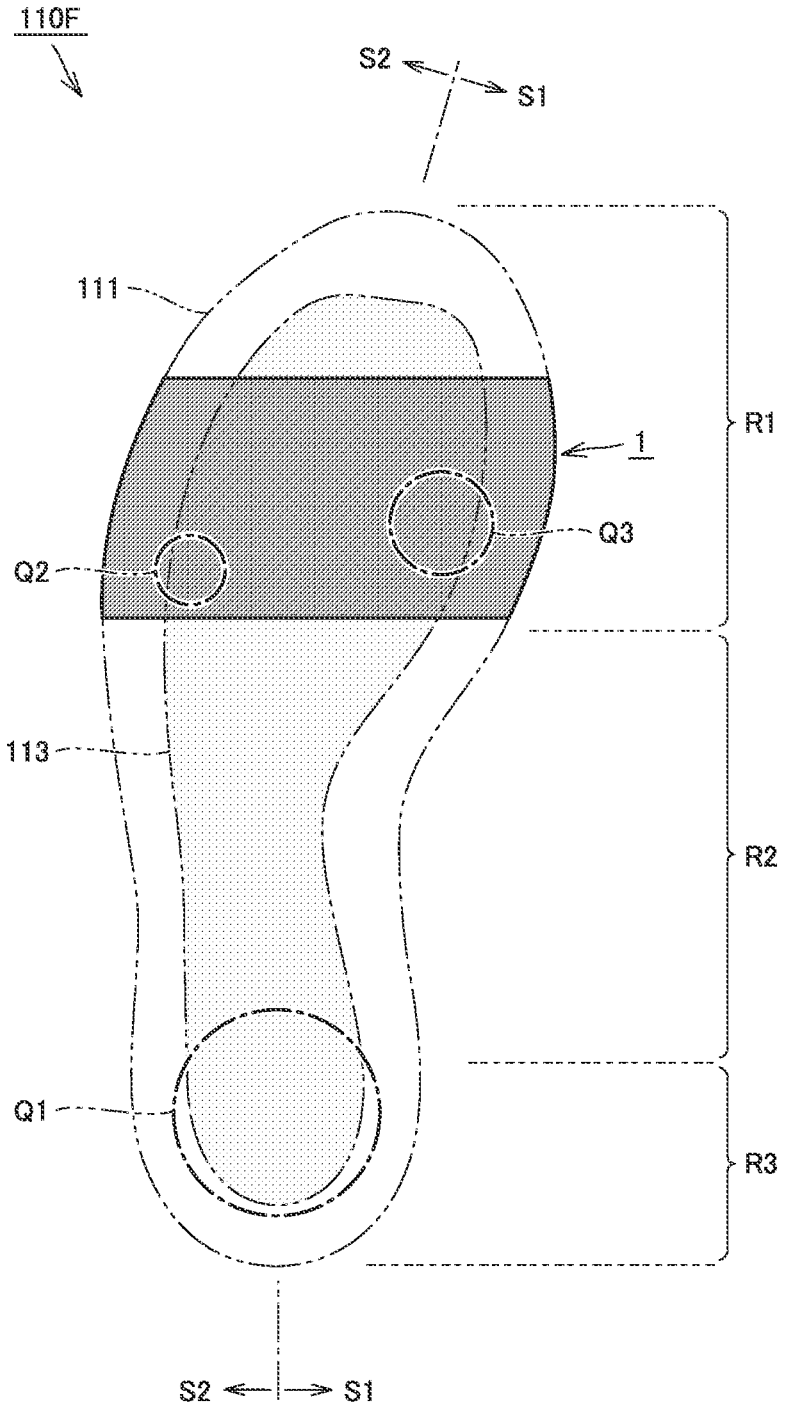
FIG. 23 is a schematic plan view of a shoe sole according to a fifth modification.

As shown in FIG. 23, in the shoe sole 110F according to the fifth modification, only one shock absorber 1 is disposed at the rear end portion of the forefoot portion R1 in the midsole 111. Thereby, the shock absorber 1 is located to completely overlap with the portions Q2 and Q3 that support the hypothenar and the ball, respectively, of the wearer's foot.

Also in the configuration as described above, the shock absorber 1 is to be disposed in the portions Q2 and Q3 that support the hypothenar and the ball, respectively, of the wearer's foot as portions to which relatively high load is applied during the foot landing action. Therefore, a shoe sole and a shoe that are capable of effectively achieving high shock absorbing performance can be obtained.

Figure 24:
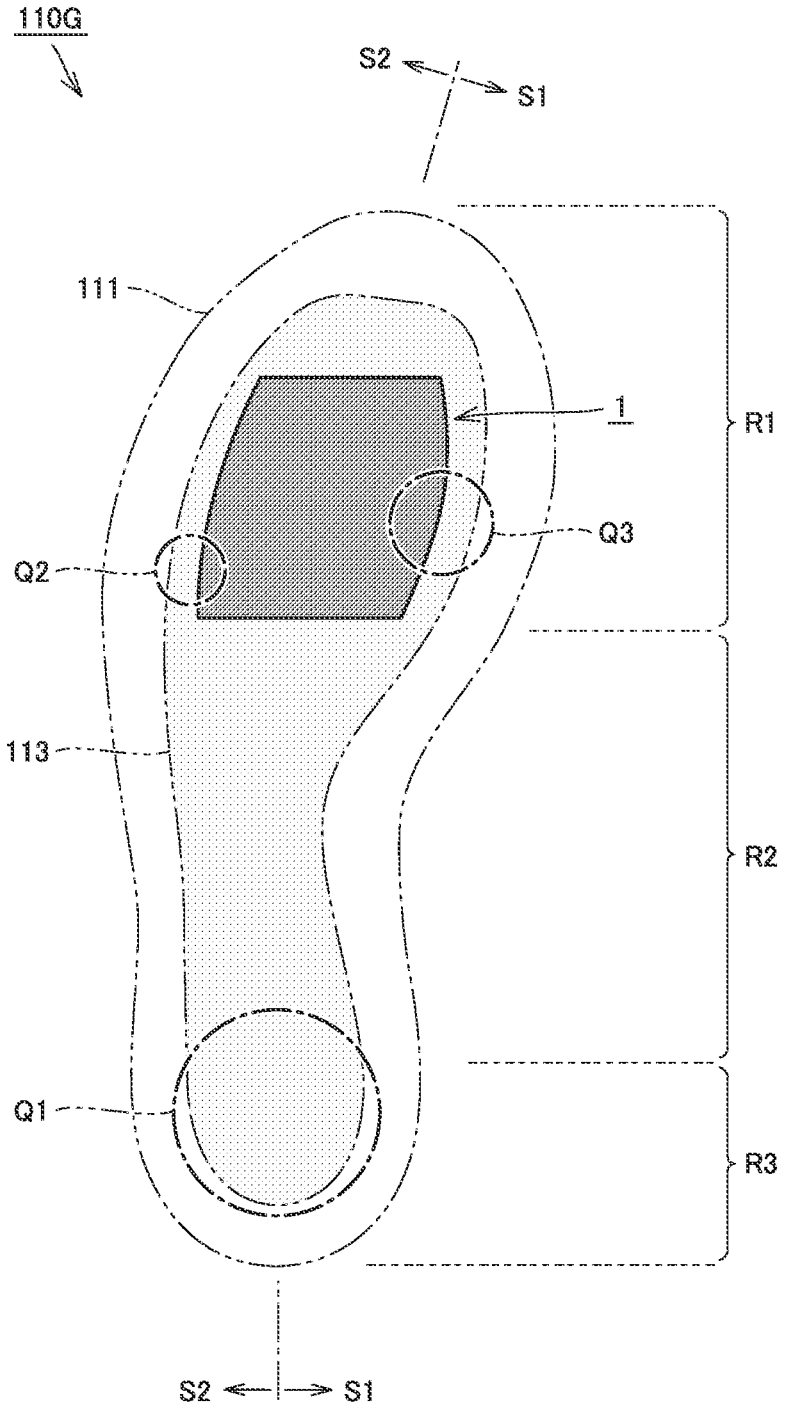
FIG. 24 is a schematic plan view of a shoe sole according to a sixth modification.

As shown in FIG. 24, in the shoe sole 110G according to the sixth modification, only one shock absorber 1 is disposed in the midsole 111 and located in the rear end portion of the forefoot portion R1 and in the central portion in the foot width direction. Thus, the shock absorber 1 is located along the portions Q2 and Q3 that support the hypothenar and the ball, respectively, of the wearer's foot.

Also in the configuration as described above, the shock absorber 1 is to be disposed in the portions Q2 and Q3 that support the hypothenar and the ball, respectively, of the wearer's foot as portions to which relatively high load is applied during the foot landing action. Therefore, a shoe sole and a shoe that are capable of effectively achieving high shock absorbing performance can be obtained.

Figure 25:
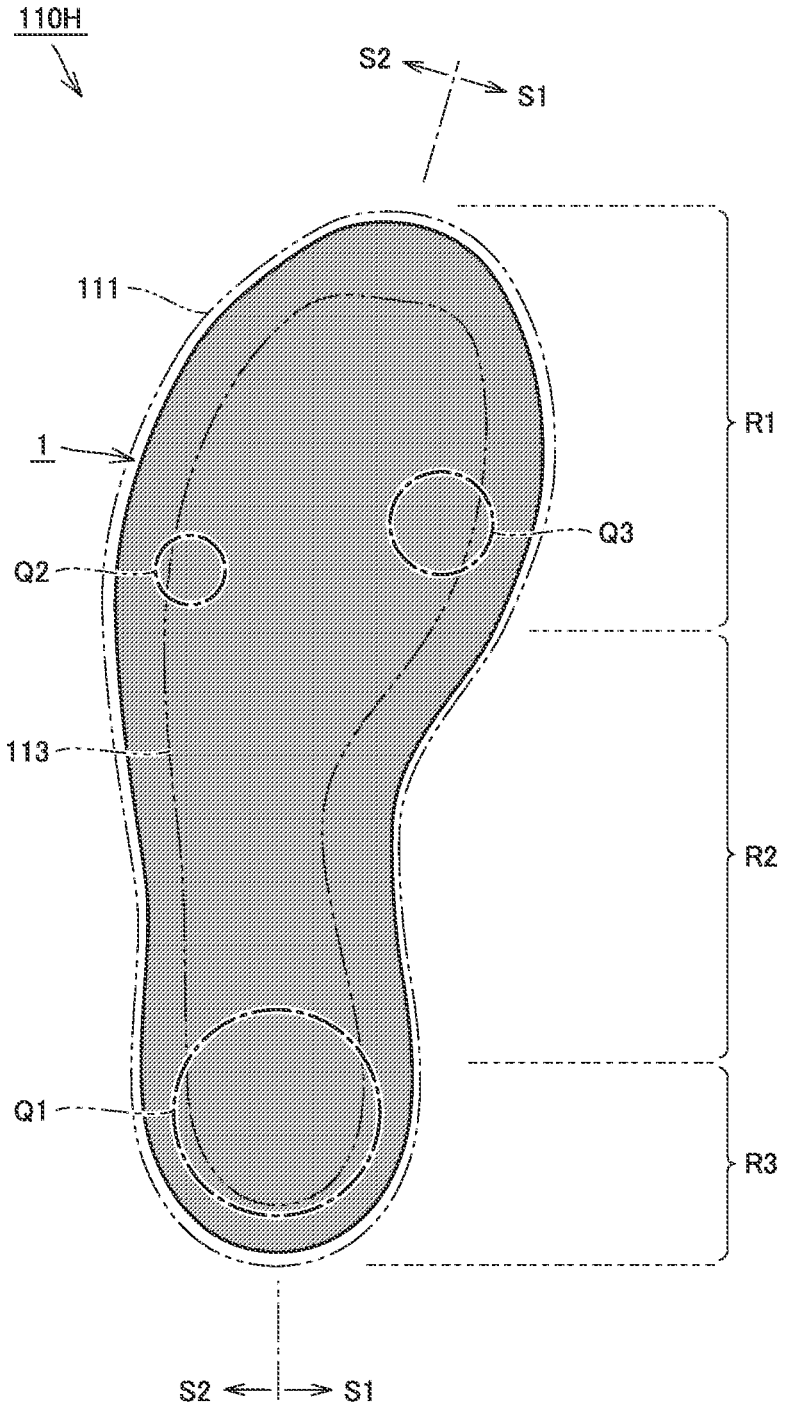
FIG. 25 is a schematic plan view of a shoe sole according to a seventh modification.

As shown in FIG. 25, in the shoe sole 110H according to the seventh modification, only one shock absorber 1 is provided substantially entirely across the forefoot portion R1, the midfoot portion R2, and the rearfoot portion R3 in the midsole 111. Thereby, the shock absorber 1 is located to completely overlap with the portions Q1, Q2, and Q3 that support the heel, the hypothenar, and the ball, respectively, of the wearer's foot.

Also in the configuration as described above, the shock absorber 1 is to be disposed in: the portion Q1 that supports the heel of the wearer's foot as a portion to which the highest load is applied during the foot landing action; and the portions Q2 and Q3 that support the hypothenar and the ball, respectively, of the wearer's foot as portions to which relatively high load is applied during the foot landing action. Therefore, a shoe sole and a shoe that are capable of effectively achieving high shock absorbing performance can be obtained.

Eighth to Eleventh Modifications

FIGS. 26 to 29 are schematic side views of shoe soles according to the eighth to eleventh modifications when viewed from the lateral foot side. Referring to FIGS. 26 to 29, the following describes shoe soles 110I to 110L respectively according to the eighth to eleventh modifications based on the above-described embodiment. Each of the shoe soles 110I to 110L according to the eighth to eleventh modifications is provided in the shoe 100 in place of the shoe sole 110A according to the above-described embodiment.

As shown in FIGS. 26 to 29, each of the shoe soles 110I to 110L according to the eighth to eleventh modifications is different in configuration from the shoe sole 110A according to the above-described embodiment in arrangement position of the shock absorber 1 in a side view, or additionally, in arrangement position, number, presence or absence and the like of the highly rigid plate 113. In this case, in FIGS. 26 to 29, without representing the specific shape of the shock absorber 1 for convenience of illustration, the region where the shock absorber 1 is disposed is shown in dark color while the region where the highly rigid plate 113 is disposed is shown in light color. In each of the shoe soles 110I to 110L according to the eighth to the eleventh modifications, only one shock absorber 1 is disposed at a position overlapping with the portion Q1 that supports the heel of the wearer's foot when the midsole 111 is seen in a plan view.

Figure 26:
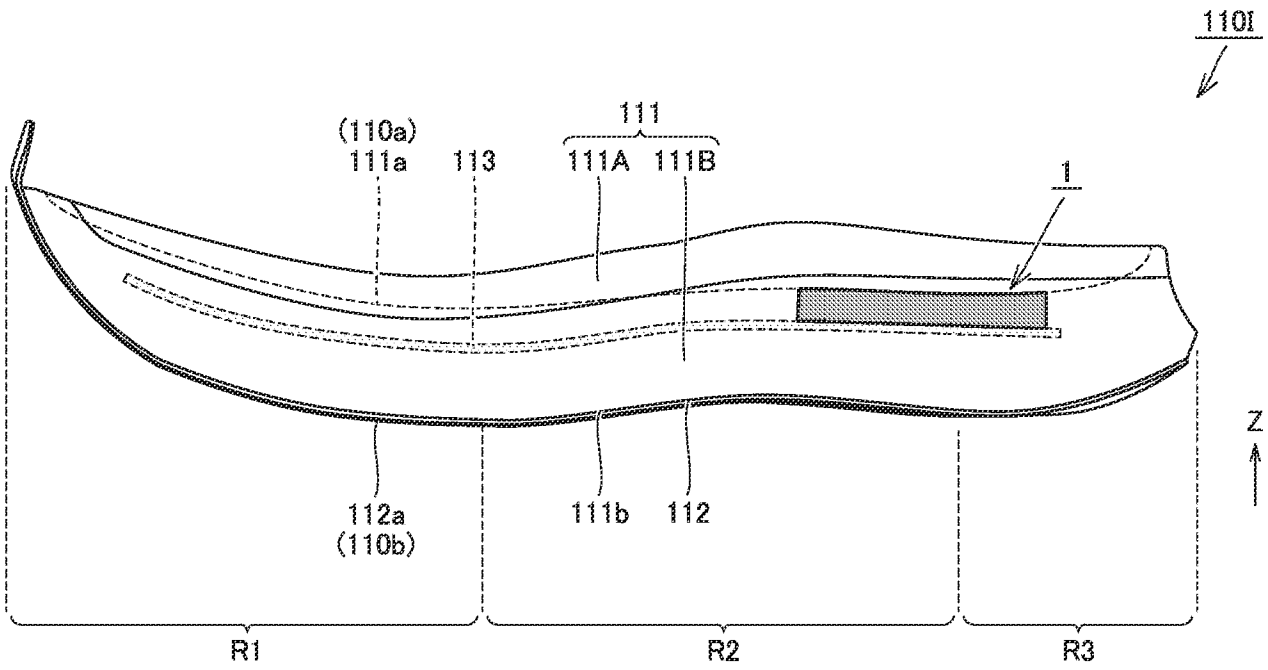
FIG. 26 is a schematic side view of a shoe sole according to an eighth modification when viewed from the lateral foot side.

As shown in FIG. 26, in the shoe sole 110I according to the eighth modification, the highly rigid plate 113 is disposed at the same position as that in the shoe sole 110A according to the above-described embodiment, while the shock absorber 1 is not disposed between the highly rigid plate 113 and the outsole 112 but disposed above the highly rigid plate 113.

Specifically, the shock absorber 1 is embedded in the midsole 111 such that the upper surface (i.e., the upper wall portion 11) of the shock absorber 1 defines the top surface 110*a* of the shoe sole 110I while the lower surface (i.e., the lower wall portion 12) of the shock absorber 1 reaches the highly rigid plate 113. Thereby, the lower wall portion 12 of the shock absorber 1 is bonded to the upper surface of the highly rigid plate 113, for example, with an adhesive or the like, so that the shock absorber 1 is fixed to the highly rigid plate 113.

Also in the configuration as described above, the shock absorber 1 is to be disposed in the portion Q1 that supports the heel of the wearer's foot as a portion to which the highest load is applied during the foot landing action. Therefore, a shoe sole and a shoe that are capable of effectively achieving high shock absorbing performance can be obtained.

Figure 27:
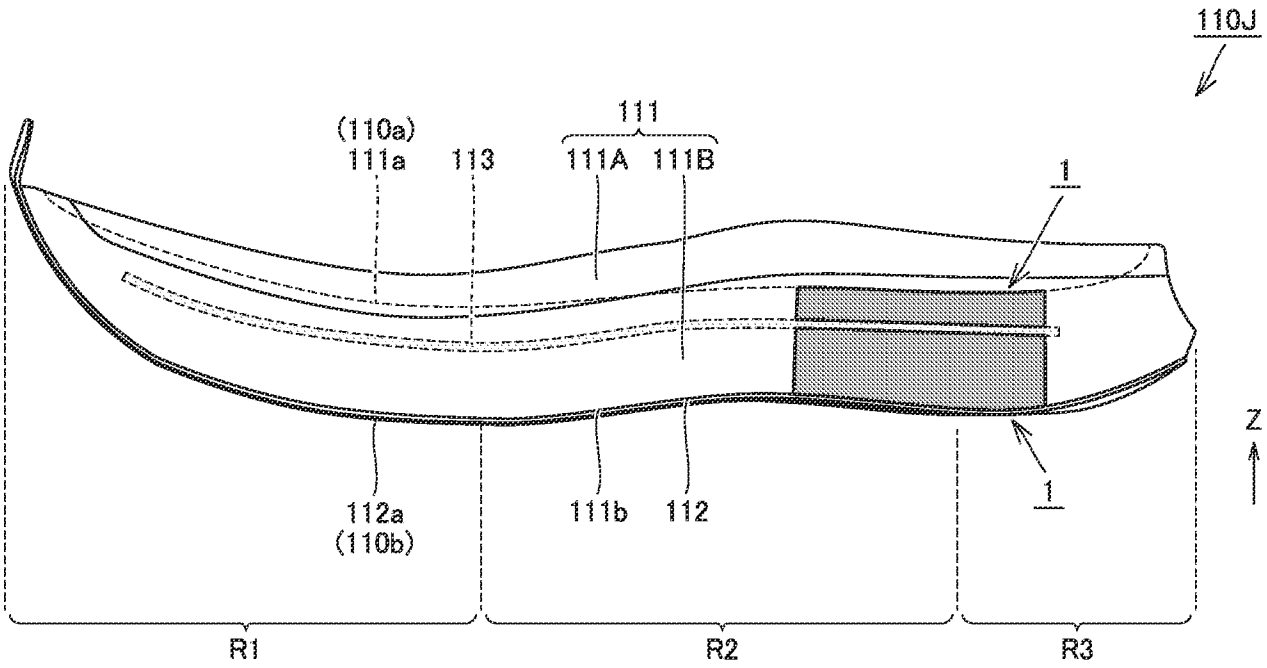
FIG. 27 is a schematic side view of a shoe sole according to a ninth modification when viewed from the lateral foot side.

As shown in FIG. 27, in the shoe sole 110J according to the ninth modification, the highly rigid plate 113 is disposed at the same position as that in the shoe sole 110A according to the above-described embodiment, while the shock absorber 1 is disposed not only between the highly rigid plate 113 and the outsole 112 but also above the highly rigid plate 113. The specific configuration of the pair of shock absorbers 1 is the same as those of the shoe sole 110A according to the above-described embodiment and the shoe sole 110I according to the eighth modification.

Also in the configuration as described above, the shock absorber 1 is to be disposed in the portion Q1 that supports the heel of the wearer's foot as a portion to which the highest load is applied during the foot landing action. Therefore, a shoe sole and a shoe that are capable of effectively achieving high shock absorbing performance can be obtained.

Figure 28:
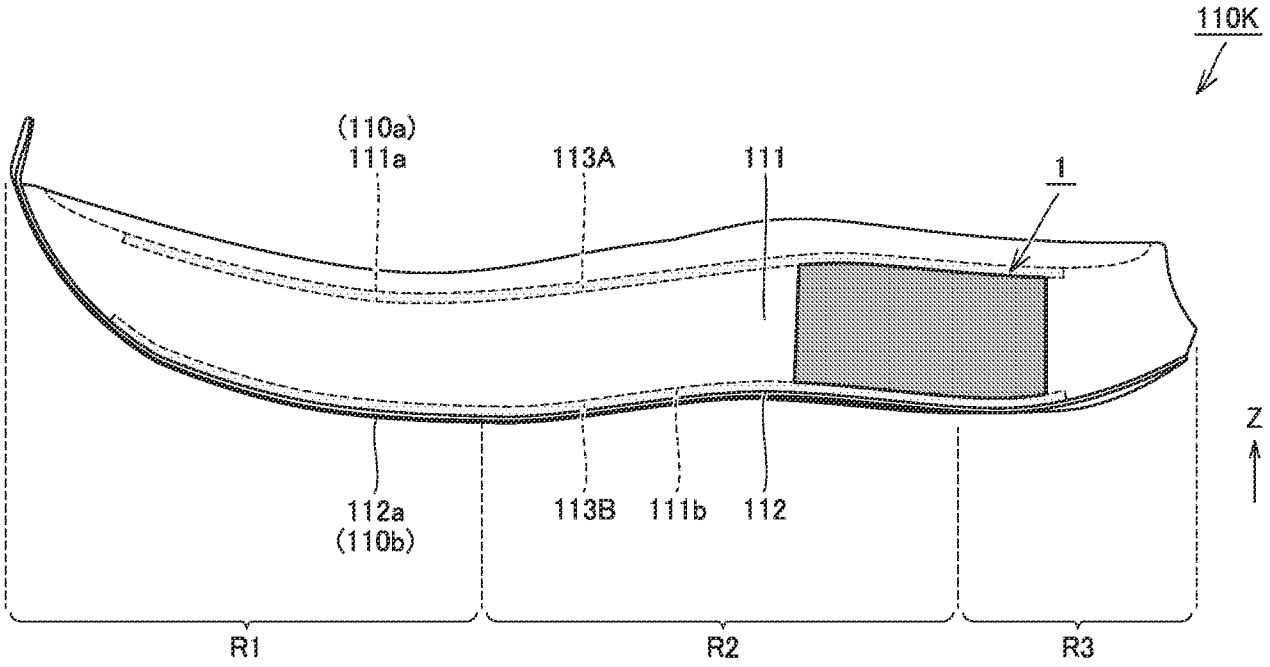
FIG. 28 is a schematic side view of a shoe sole according to a tenth modification when viewed from the lateral foot side.

As shown in FIG. 28, the shoe sole 110K according to the tenth modification is different from the shoe sole 110A according to the above-described embodiment in configuration of the midsole 111, in arrangement position and number of the highly rigid plate(s) 113, and also in arrangement position of the shock absorber 1, as described above.

Specifically, in the shoe sole 110K according to the tenth modification, the midsole 111 is formed of a single member, an upper highly rigid plate 113A is disposed so as to cover an upper surface 111*a* of the midsole 111, and a lower highly rigid plate 113B is disposed so as to cover a lower surface 111*b* of the midsole 111. Thus, the upper surface of the upper highly rigid plate 113A defines a top surface 110*a* of the shoe sole 110K.

The shock absorber 1 is embedded in the midsole 111 such that the upper surface (i.e., the upper wall portion 11) of the shock absorber 1 reaches the upper highly rigid plate 113A while the lower surface (i.e., the lower wall portion 12) of the shock absorber 1 reaches the lower highly rigid plate 113B. Accordingly, the upper wall portion 11 of the shock absorber 1 is bonded to the lower surface of the upper highly rigid plate 113A, for example, with an adhesive or the like, and the lower wall portion 12 of the shock absorber 1 is bonded to the upper surface of the lower highly rigid plate 113B, for example, with an adhesive or the like, so that the shock absorber 1 is fixed to this pair of the upper highly rigid plate 113A and the lower highly rigid plate 113B.

Also in the configuration as described above, the shock absorber 1 is to be disposed in the portion Q1 that supports the heel of the wearer's foot as a portion to which the highest load is applied during the foot landing action. Therefore, a shoe sole and a shoe that are capable of effectively achieving high shock absorbing performance can be obtained.

Figure 29:
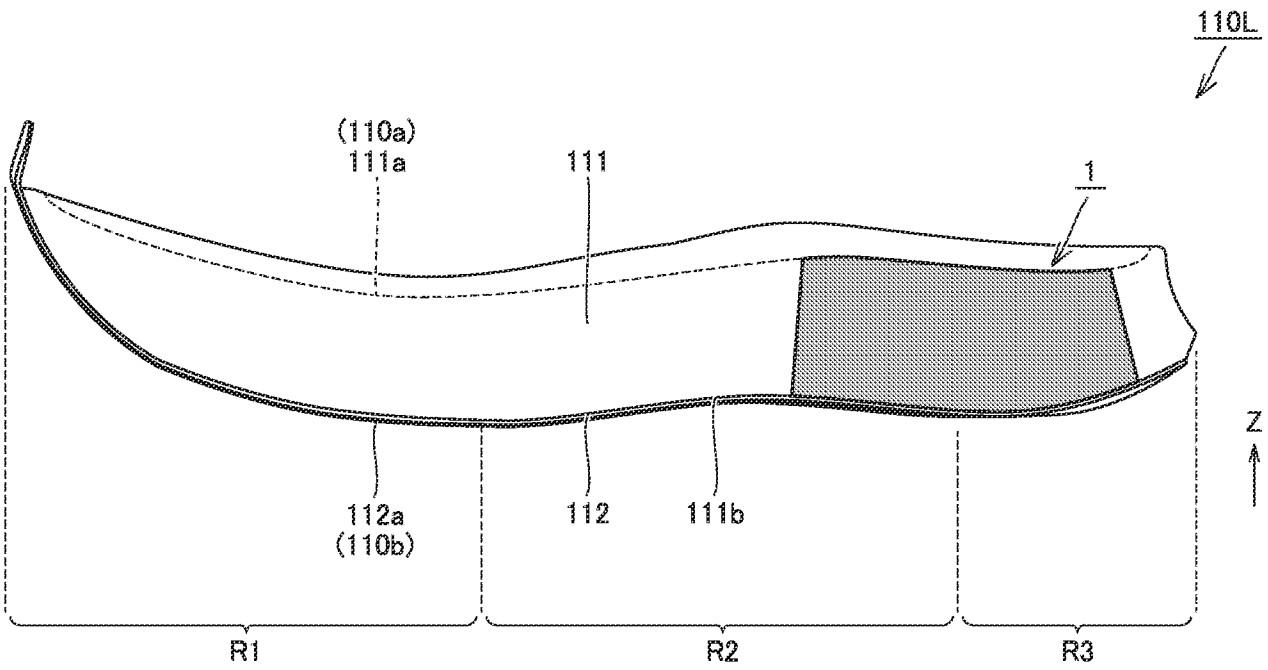
FIG. 29 is a schematic side view of a shoe sole according to an eleventh modification when viewed from the lateral foot side.

As shown in FIG. 29, the shoe sole 110L according to the eleventh modification is different from the shoe sole 110A according to the above-described embodiment in configuration of the midsole 111, in configuration in which the highly rigid plate 113 (see FIG. 15 and the like) is not provided, and further, in arrangement position of the shock absorber 1.

Specifically, in the shoe sole 110L according to the eleventh modification, the midsole 111 is formed of a single member, and the shock absorber 1 is disposed so as to be exposed on both the upper surface 111*a* and the lower surface 111*b* of the midsole 111. Thereby, the shock absorber 1 is embedded in the midsole 111 such that the upper surface (i.e., the upper wall portion 11) of the shock absorber 1 defines the top surface 110*a* of the shoe sole 110L and the lower surface (i.e., the lower wall portion 12) of the shock absorber 1 reaches the outsole 112. Accordingly, the lower wall portion 12 of the shock absorber 1 is bonded to the upper surface of the outsole 112, for example, with an adhesive or the like, so that the shock absorber 1 is fixed to the outsole 112.

Also in the configuration as described above, the shock absorber 1 is to be disposed in the portion Q1 that supports the heel of the wearer's foot as a portion to which the highest load is applied during the foot landing action. Therefore, a shoe sole and a shoe that are capable of effectively achieving high shock absorbing performance can be obtained.

Figure 30A:
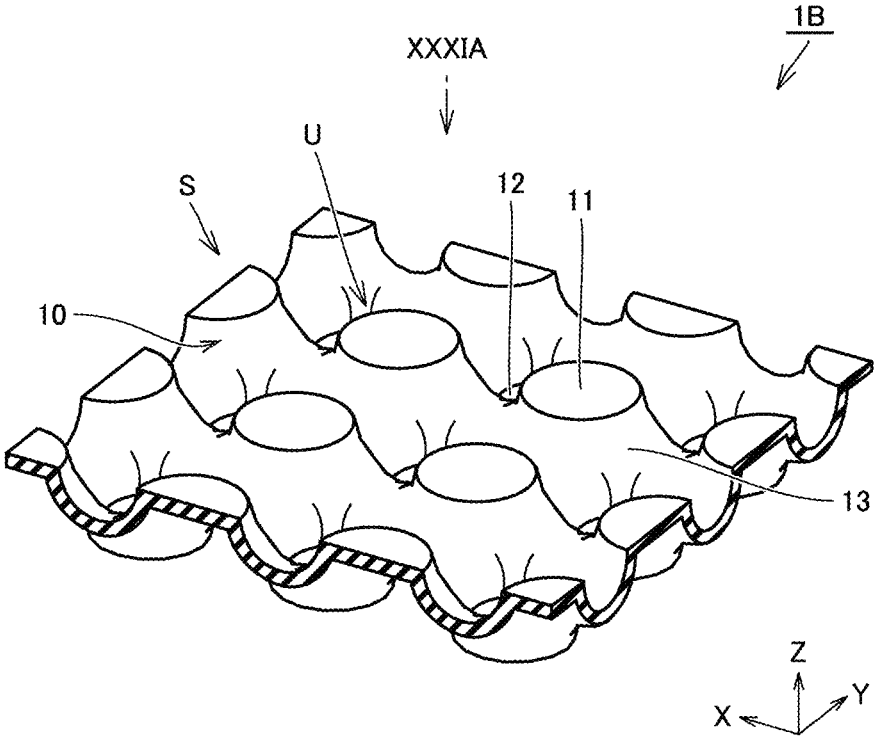
FIG. 30A is a perspective view of a shock absorber similar in structure to the shock absorber included in the shoe sole according to the embodiment.
Figure 30B:
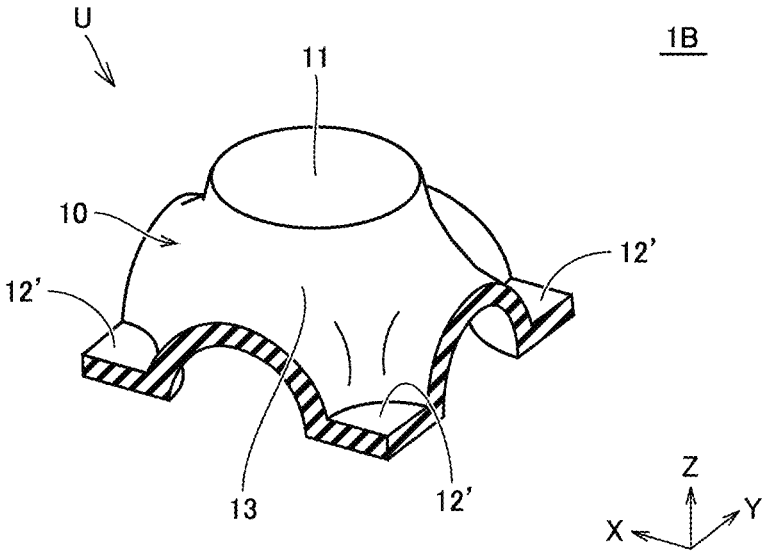
FIG. 30B is a perspective view of a unit structure body forming the shock absorber shown in FIG. 30A.
Figure 31A:
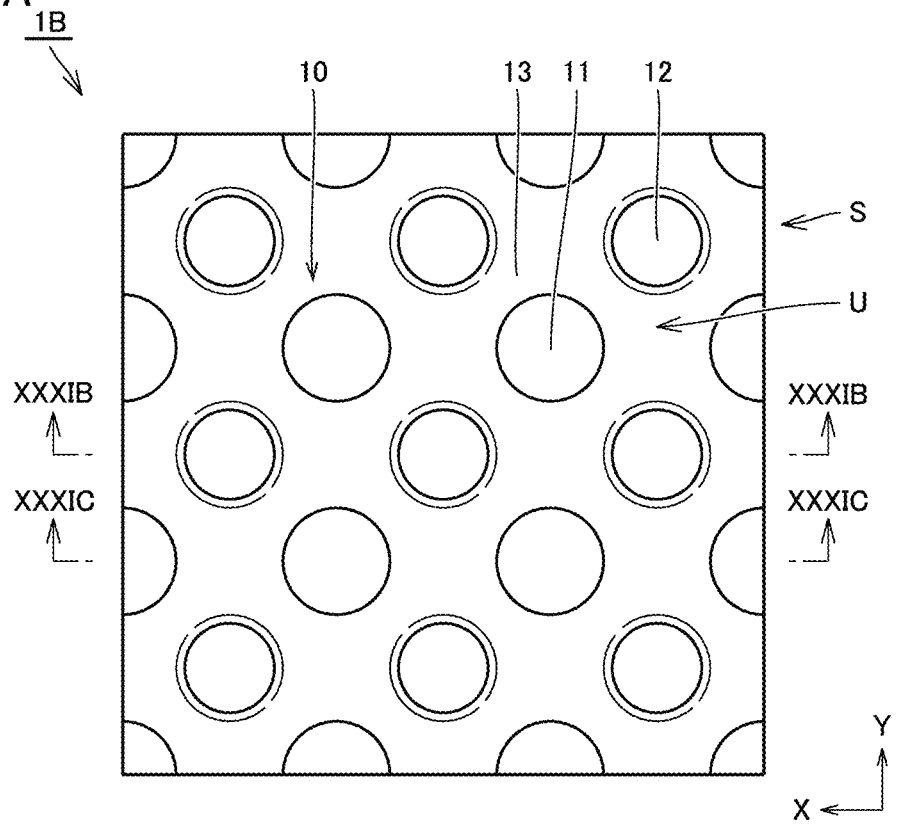
FIG. 31A is a plan view of the shock absorber shown in FIG. 30A.
Figure 31B:
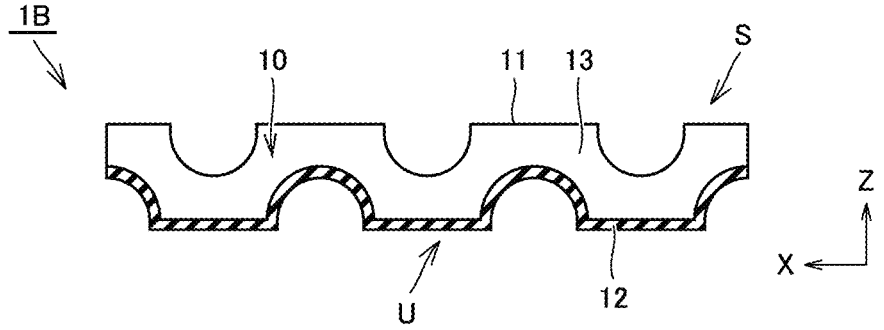
FIGS. 31B and 31C are cross-sectional views of the shock absorber shown in FIG. 30A.
Figure 31C:
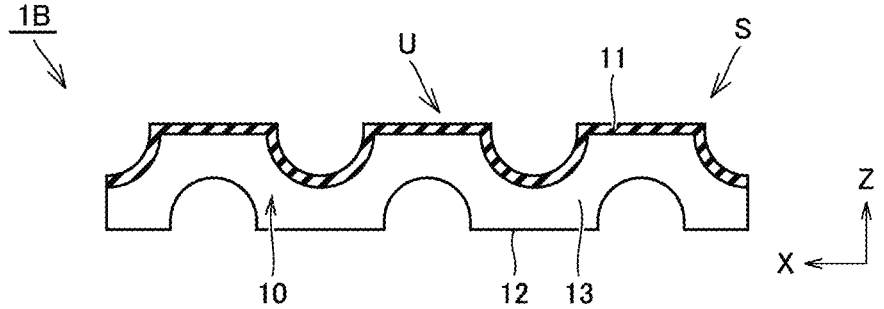

Shock Absorber Similar in Structure to Shock Absorber Included in Shoe Sole According to Embodiment FIG. 30A is a perspective view of a shock absorber similar in structure to the shock absorber included in the shoe sole according to the embodiment. FIG. 30B is a perspective view of a unit structure body forming the shock absorber. FIG. 31A is a plan view showing the shock absorber in FIG. 30A and taken along the direction indicated by an arrow XXXIA in FIG. 30A. FIGS. 31B and 31C are cross-sectional views taken along lines XXXIB-XXXIB and XXXIC-XXXIC, respectively, shown in FIG. 31A. With reference to FIGS. 30A, 30B, and 31A to 31C, the following describes the configuration of a shock absorber 1B similar in structure to the shock absorber included in the shoe sole according to the above-described embodiment.

As shown in FIGS. 30A and 31A to 31C, the shock absorber 1B includes a three-dimensional structure S having a plurality of unit structure bodies U. Each of the plurality of unit structure bodies U has a three-dimensional shape formed by a wall 10 having an outer shape defined by a pair of parallel curved surfaces (see FIG. 30B). Thereby, the three-dimensional structure S also has a three-dimensional shape formed by the wall 10 having an outer shape defined by a pair of parallel curved surfaces.

The unit structure body U has a structure obtained by adding a thickness to a base structure unit having a geometrical surface structure. More specifically, the unit structure body U is formed by adding a thickness to each of divided structure units obtained by dividing a structure unit having a mathematically defined triply periodic minimal surface into two in one of its orthogonal three-axis directions. Note that a minimal surface is defined as a curved surface that is minimal in area among the curved surfaces having a given closed curve as a boundary.

In this case, in the unit structure body U shown in FIG. 30B, the above-described surface structure is a Schwartz P structure, and the unit structure body U is formed by adding a thickness to each of divided structure units obtained by dividing a structure unit having the Schwartz P structure into two in the height direction (the Z-axis direction shown in the figure) among the orthogonal three-axis directions.

More specifically, the unit structure body U includes one upper wall portion 11, four divided lower wall portions 12', and one upright wall portion 13 connecting the upper wall portion 11 and the lower wall portions 12'. The upright wall portion 13 extends to intersect with the upper wall portion 11 and the lower wall portions 12', and is entirely formed in a substantially annular shape. Note that each of the upper wall portion 11 and the lower wall portions 12' has a flat plate shape, and the upright wall portion 13 has a curved plate shape.

Each of the four divided lower wall portions 12' included in one unit structure body U is arranged continuously to, and thereby integrated with, one of the lower wall portions 12' included in another unit structure body U adjacent to the one unit structure body U. Thus, in the three-dimensional structure S, each of the lower wall portions 12' included in each of four unit structure bodies U adjacent to each other is arranged continuously to an adjacent lower wall portion 12' included in a corresponding one of these four unit structure bodies U, to thereby form one lower wall portion 12 substantially similar in shape to the above-mentioned one upper wall portion 11 (see FIG. 30A and the like).

The shock absorber 1B according to the present embodiment is intended to exhibit a shock absorbing function in the above-mentioned height direction. Thus, as shown in FIGS. 30A and 31A to 31C, the plurality of unit structure bodies U are repeatedly arranged in a regular and continuous manner in each of a width direction (an X direction shown in the figure) and a depth direction (a Y direction shown in the figure) among the orthogonal three-axis directions. Thereby, the three-dimensional structure S has a structure in which upward protruding portions and downward protruding portions are alternately arranged in a plan view. FIGS. 30A and 31A to 31C each show only three unit structure bodies U arranged adjacent to each other in the width direction and the depth direction.

In this case, the present embodiment is described with reference to the shock absorber 1B that is formed of a large number of unit structure bodies U arranged in the width direction and the depth direction, but the number of unit structure bodies U repeatedly arranged in the width direction and the depth direction is not particularly limited. In other words, the shock absorber may be formed by arranging two or more unit structure bodies U in only one of the width direction and the depth direction, or may be formed of only a single unit structure body U.

The method of manufacturing the shock absorber 1A and the material of the shock absorber 1A as described above are applicable as the method of manufacturing the shock absorber 1B and the material of the shock absorber 1B.

Similarly to the above-described shock absorber 1A, the shock absorber 1B configured in this way also undergoes compressive deformation when a load is gradually applied to the shock absorber 1B by pressurization in the height direction (the Z-axis direction shown in the figure). At this time, due to the structure of the shock absorber 1B, the upright wall portion 13 deforms, and then, application of a load above a certain level causes buckling in the upright wall portion 13.

On the other hand, when application of the pressure is stopped, the load applied to the shock absorber 1B in the height direction decreases and disappears. Thereby, the compressive deformation occurring in the shock absorber 1B disappears and the shock absorber 1B returns to its original shape. At this time, buckling occurring in the shock absorber 1B also disappears.

<Verification Test 5>

In Verification Test 5, a simulation model corresponding to the shock absorber 1B was prepared as Verification Example 8 and subjected to a structural analysis using a finite element method (FEM), to thereby calculate a stress-strain curve of the shock absorber according to Verification Example 8 formed based on the simulation model.

Figures 32, 33:
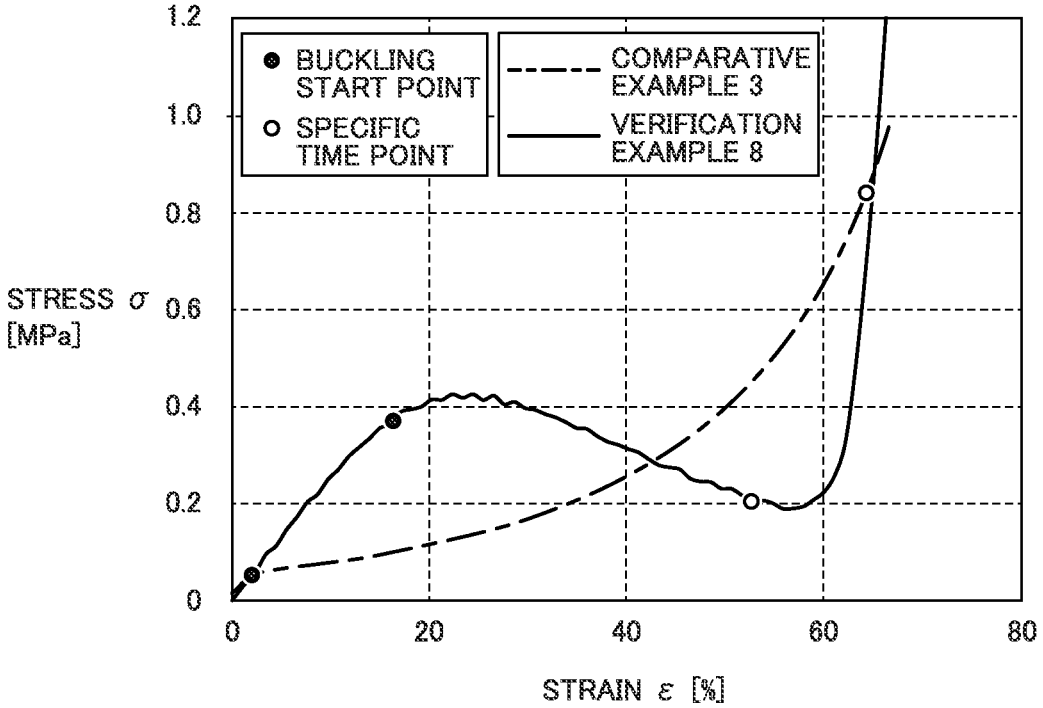
FIG. 32 is a graph showing simulation results of shock absorbing performance of a shock absorber according to Verification Example 8.
FIG. 33 is a table showing characteristics of the shock absorber according to Verification Example 8.

FIG. 32 is a graph showing simulation results of shock absorbing performance of the shock absorber according to Verification Example 8. FIG. 33 is a table showing characteristics of the shock absorber according to Verification Example 8. In this case, for comparison, FIGS. 32 and 33 each additionally show the results of Comparative Example 3 by which it was confirmed that the highest shock absorbing performance was achieved in the above-described Verification Test 1.

As shown in FIG. 32, the stress-strain curve of the shock absorber according to Verification Example 8 conformed to the stress-strain curve of the shock absorber 1A (see FIG. 4). In other words, in the case of the shock absorber according to Verification Example 8, the loading process included a region where the stress σ hardly changed even when the strain ε increased, like a region included in the stress-strain curve of the above-described shock absorber 1A.

In this case, as shown in FIG. 33, the maximum stress $\sigma_{max}$ of the shock absorber according to Verification Example 8 was 0.43 MPa, and the tangential elastic modulus of the shock absorber according to Verification Example 8 at the specific time point was −0.50 MPa.

The shock absorber according to Verification Example 8 was significantly lower in maximum stress $\sigma_{max}$ and tangential elastic modulus at the specific time point than the shock absorber according to Comparative Example 3. Thus, it was confirmed that the shock absorber 1B having the configuration as described above could achieve high shock absorbing performance.

Further, it was calculated that the buckling start point of the shock absorber according to Verification Example 8 was located at a point at which the stress σ was 0.39 MPa and the strain ε was 18.0%. In other words, it was confirmed that the buckling start point of the shock absorber according to Verification Example 8 was within both the required stress range and the required strain range as described above.

<Summary of Verification Test 5>

Based on the result of Verification Test 5 as described above, it is understood that unconventionally high shock absorbing performance can be achieved by a shock absorber as described below. In this case, specifically, the shock absorber is configured to have a three-dimensional shape formed by a wall having an outer shape defined by a pair of parallel curved surfaces such that the shock absorber may buckle when it receives compression force, and also configured to start buckling within the required strain range and the required stress range when a load is applied to the shock absorber in a gradually increasing manner. In addition, the maximum value of the stress occurring in the shock absorber from the start of application of the compressive force to the shock absorber until reaching the specific time point is set at the above-mentioned prescribed value or less, and the tangential elastic modulus of the shock absorber at the specific time point is set at the above-mentioned prescribed value or less. Thereby, unconventionally high shock absorbing performance as described above can be achieved.

In this case, while the shock absorber 1B has the unit structure body U formed by adding a thickness to each of divided structure units obtained by dividing a structure unit having the Schwartz P structure into two in the height direction, examples applicable as a structure unit having other triply periodic minimal surfaces may be a gyroid structure, a Schwartz D structure, and the like. By configuring a shock absorber by adding a thickness to each of divided structure units obtained by dividing the above-mentioned structure unit into two in one of the orthogonal three-axis directions, a shock absorber capable of achieving high shock absorbing performance can be obtained.

Shoe Sole and Shoe According to Twelfth and Thirteenth Modifications

Twelfth Modification

Figure 34:
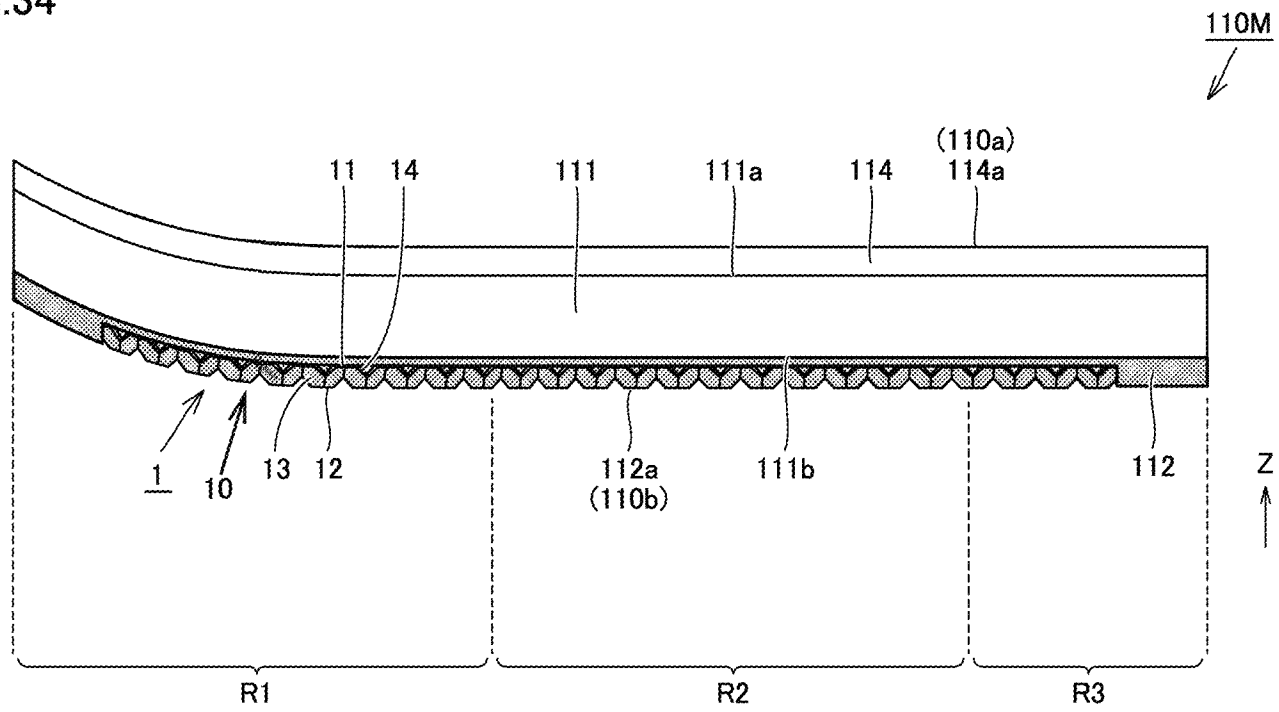
FIG. 34 is a schematic side view of a shoe sole according to a twelfth modification when viewed from the lateral foot side.
Figure 35:
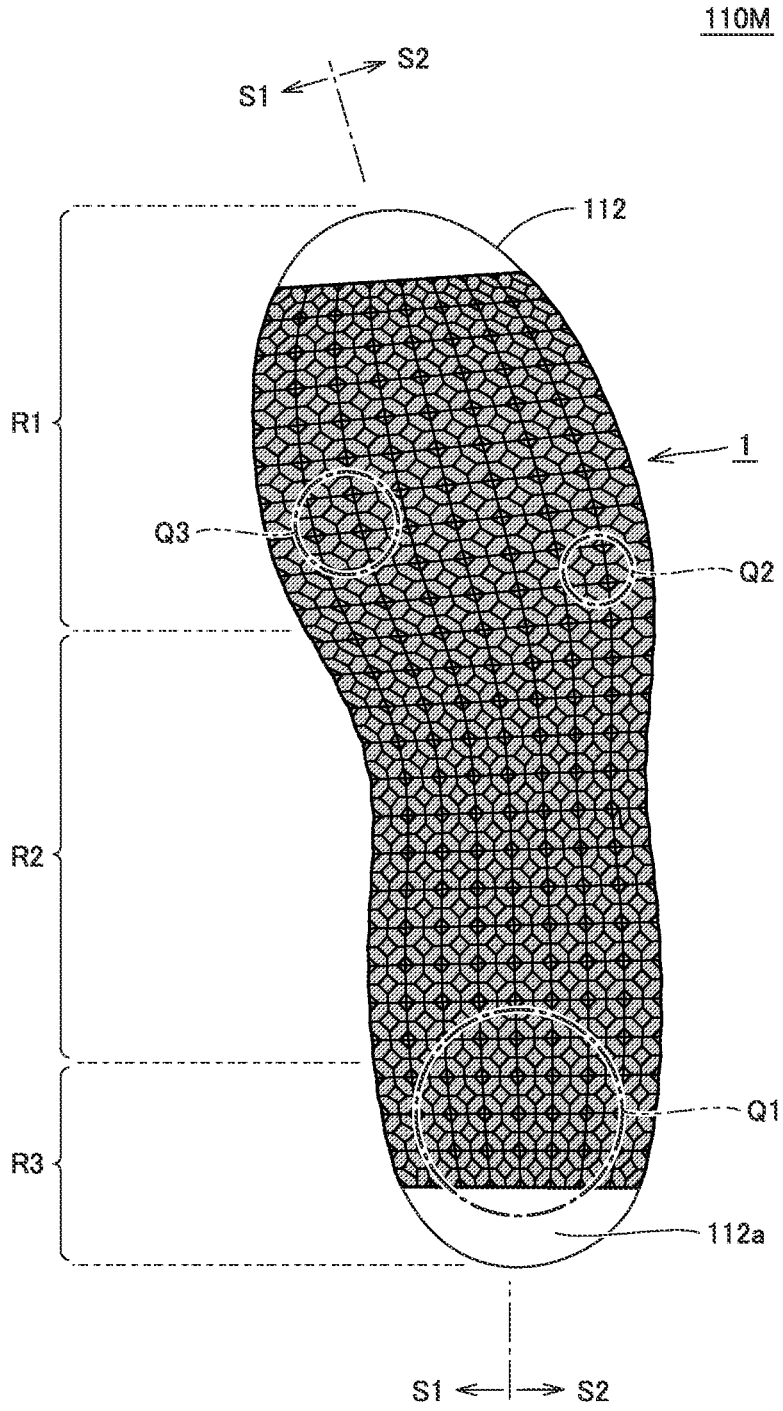
FIG. 35 is a schematic bottom view of an outsole provided in the shoe sole shown in FIG. 34.

FIG. 34 is a side view of a shoe sole according to the twelfth modification when viewed from the lateral foot side. FIG. 35 is a schematic bottom view of an outsole included in the shoe sole. Referring to FIGS. 34 and 35, the following describes a shoe sole 110M according to the twelfth modification based on the above-described embodiment. In place of the shoe sole 110A according to the above-described embodiment, the shoe sole 110M according to the twelfth modification is included in the shoe 100.

As shown in FIG. 34, the shoe sole 110M according to the twelfth modification includes a midsole 111 and an outsole 112 as in the shoe sole 110A according to the above-described embodiment, but is different from the shoe sole 110A according to the above-described embodiment in that the highly rigid plate 113 (see FIG. 15 and the like) is not provided and a sockliner 114 is provided.

Specifically, the shoe sole 110M according to the twelfth modification includes the midsole 111 and the outsole 112 as a shoe sole body, and the sockliner 114. In the shoe sole 110M, a part of the outsole 112 forms the shock absorber 1. In other words, in the shoe sole 110M, a shock absorber formed of a single member is not provided, but instead, a part of the outsole 112 is configured to function as a shock absorber.

The midsole 111 extends in the front-rear direction from the forefoot portion R1 through the midfoot portion R2 to the rearfoot portion R3. The midsole 111 is made of a material lower in rigidity than the material of the outsole 112 also serving as the shock absorber 1. Further, the midsole 111 has a substantially flat shape having an upper surface 111*a* and a lower surface 111*b*.

As shown in FIGS. 34 and 35, the outsole 112 extends in the front-rear direction from the forefoot portion R1 through the midfoot portion R2 to the rearfoot portion R3. Further, the outsole 112 is bonded to the lower surface 111*b* of the midsole 111, for example, with an adhesive or the like so as to cover the lower surface 111*b* of the midsole 111. The outsole 112 having a substantially flat shape has a lower surface defining a ground contact surface 112*a* as a bottom surface 110*b* of the shoe sole 110M.

A portion functioning as the above-described shock absorber 1 is provided at a prescribed position on the lower surface of the outsole 112. In order to facilitate understanding, this portion is shown in dark color in the figure. The portion functioning as the shock absorber 1 in the outsole 112 has a three-dimensional shape formed by a wall 10 having an outer shape defined by a pair of parallel flat surfaces, and includes a plurality of upper wall portions 11, a plurality of lower wall portions 12, and a plurality of upright wall portions 13 as described above. Thereby, the portion functioning as the shock absorber 1 in the outsole 112 is located so as to be exposed to the outside in the portion of the shoe sole 110M on the bottom surface 110*b* side. A plurality of opened portions 14 are located on the side portion of the outsole 112 in the portion functioning as the shock absorber 1.

In this case, the portion functioning as the shock absorber 1 in the outsole 112 is provided in the substantially entire area of the ground contact surface 112*a* of the outsole 112, excluding the portion closer to the front end of the forefoot portion R1 and the portion closer to the rear end of the rearfoot portion R3, and is located to include a portion Q1 that supports a heel of the wearer's foot, a portion Q2 that supports a hypothenar of the wearer's foot, and a portion Q3 that supports a ball of the wearer's foot.

The outsole 112 can be made of thermoplastic elastomer or rubber, and can be manufactured, for example, by molding such as injection molding using a mold, cast molding, sheet molding, additive manufacturing using a three-dimensional additive manufacturing apparatus, or the like.

As shown in FIG. 34, the sockliner 114 extends in the front-rear direction from the forefoot portion R1 through the midfoot portion R2 to the rearfoot portion R3, and is located so as to cover the upper surface 111*a* of the midsole 111. The sockliner 114 having a substantially flat shape has an upper surface 114*a* defining a top surface 110*a* of the shoe sole 110M.

The sockliner 114 is detachably provided on the upper surface 111*a* of the midsole 111, and more specifically, is inserted into a space inside the upper 120 and thereby disposed on the upper surface 111*a* of the midsole 111. The material of the sockliner 114 is not particularly limited, and the sockliner 114 can be made of various types of resin materials, rubber materials, or the like.

In the shoe sole 110M described above, the shock absorber 1 is formed of a part of the outsole 112 as described above. Thus, based on the high shock absorbing performance achieved by the portion functioning as the shock absorber 1 in the outsole 112, the stress occurring in the shoe sole 110M at the time point when the strain energy accumulated in the shoe sole 110M during the foot landing action becomes maximum can be suppressed to be smaller. Thus, by the configuration as described above, a shoe sole dramatically enhanced in shock absorbing performance and a shoe including the shoe sole can be obtained.

Thirteenth Modification

Figure 36:
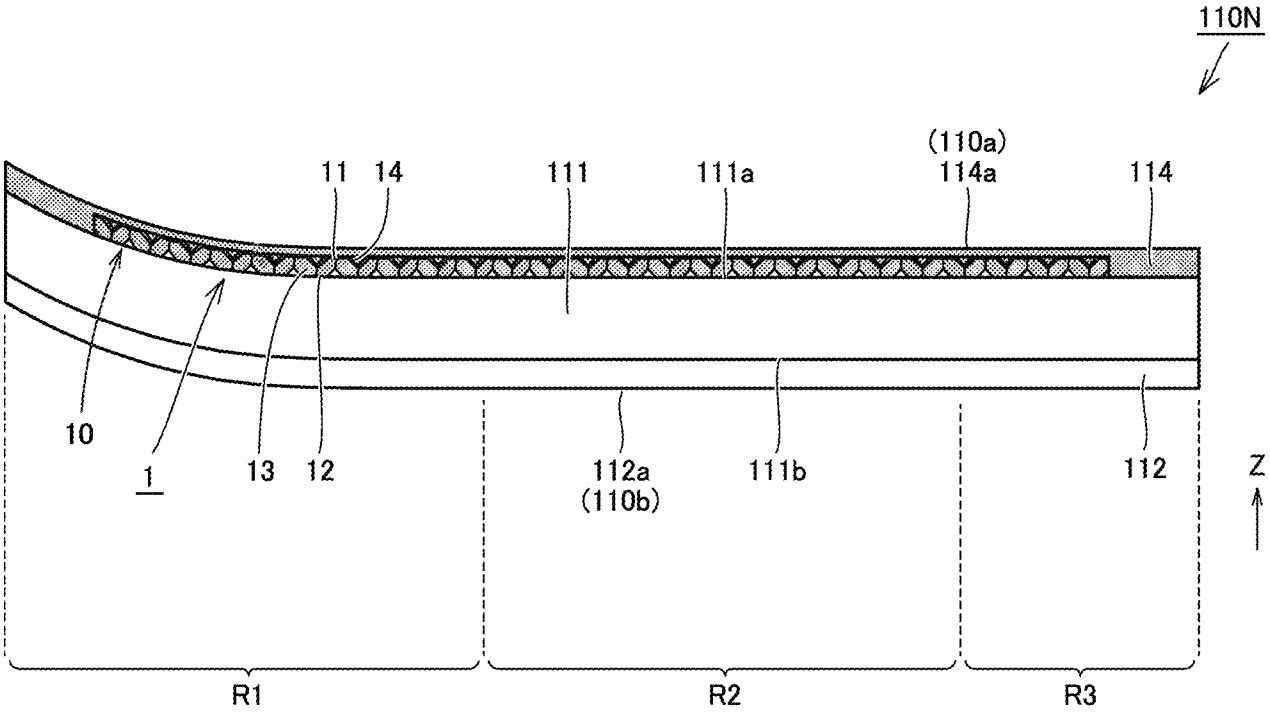
FIG. 36 is a schematic side view of a shoe sole according to a thirteenth modification when viewed from the lateral foot side.
Figure 37:
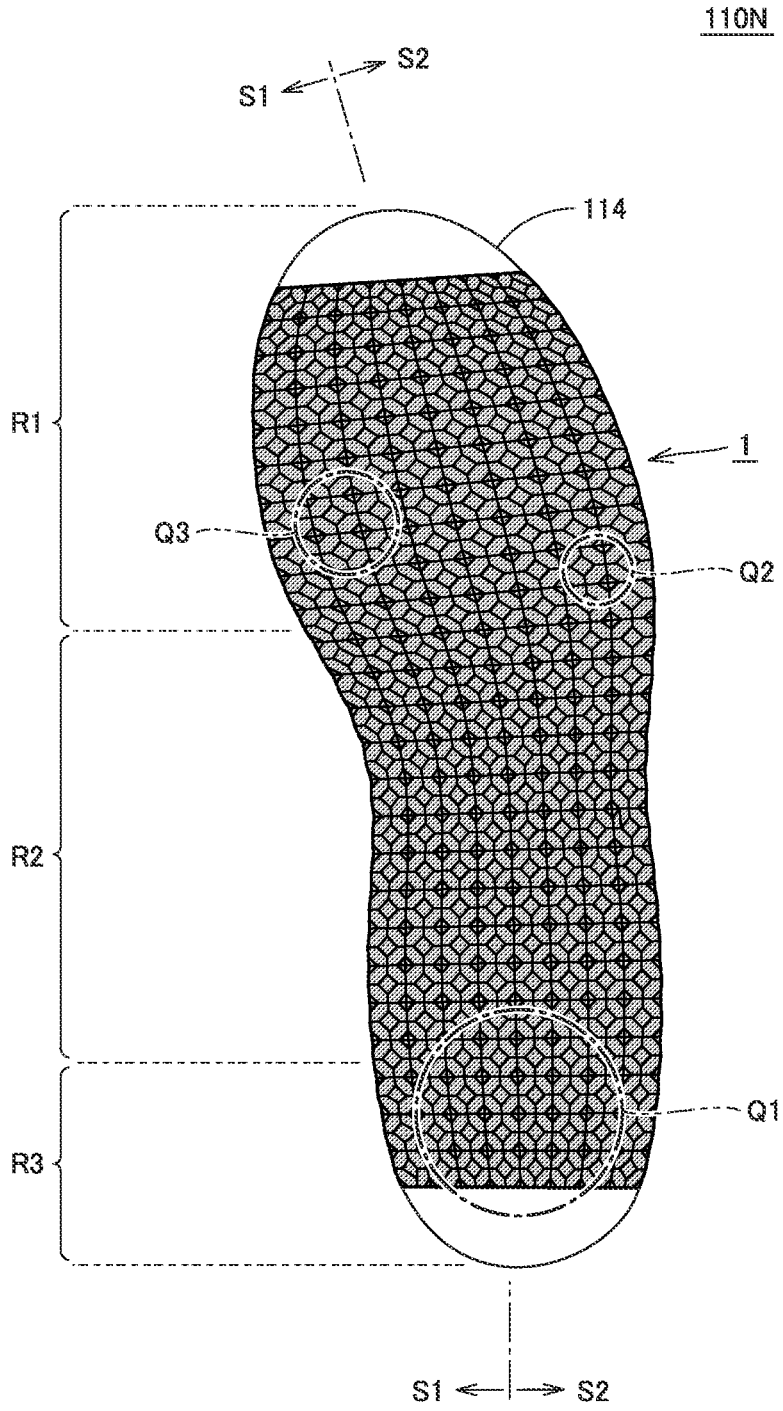
FIG. 37 is a schematic bottom view of a sockliner provided in the shoe sole shown in FIG. 36.

FIG. 36 is a side view of a shoe sole according to the thirteenth modification when viewed from the lateral foot side. FIG. 37 is a schematic bottom view of a sockliner included in the shoe sole. Referring to FIGS. 36 and 37, the following describes a shoe sole 110N according to the thirteenth modification based on the above-described embodiment. In place of the shoe sole 110A according to the above-described embodiment, the shoe sole 110N according to the present thirteenth modification is included in the shoe 100.

As shown in FIG. 36, the shoe sole 110N according to the thirteenth modification includes a midsole 111 and an outsole 112 as in the shoe sole 110A according to the above-described embodiment, but is different from the shoe sole 110A according to the above-described embodiment in that the highly rigid plate 113 (see FIG. 15 and the like) is not provided and the sockliner 114 is provided.

Specifically, the shoe sole 110N according to the thirteenth modification includes the midsole 111 and the outsole 112 as a shoe sole body, and the sockliner 114. In the shoe sole 110N, a part of the sockliner 114 forms the shock absorber 1. In other words, in the shoe sole 110N, a shock absorber formed of a single member is not provided, but instead, a part of the sockliner 114 is configured to function as a shock absorber.

The midsole 111 extends in the front-rear direction from the forefoot portion R1 through the midfoot portion R2 to the rearfoot portion R3. The midsole 111 is made of a material lower in rigidity than the material of the sockliner 114 also serving as the shock absorber 1, and has a substantially flat shape having an upper surface 111*a* and a lower surface 111*b*.

The outsole 112 extends in the front-rear direction from the forefoot portion R1 through the midfoot portion R2 to the rearfoot portion R3, and is bonded to the lower surface 111*b* of the midsole 111, for example, with an adhesive or the like so as to cover the lower surface 111*b* of the midsole 111. The outsole 112 having a substantially flat shape has a lower surface defining a ground contact surface 112*a* as a bottom surface 110*b* of the shoe sole 110N. The material of the outsole 112 is not particularly limited, and the outsole 112 can be made of various types of resin materials, rubber materials, or the like.

As shown in FIGS. 36 and 37, the sockliner 114 extends in the front-rear direction from the forefoot portion R1 through the midfoot portion R2 to the rearfoot portion R3, and is located so as to cover the upper surface 111*a* of the midsole 111. The sockliner 114 having a substantially flat shape has an upper surface 114*a* defining a top surface 110*a* of the shoe sole 110N.

The sockliner 114 is detachably provided on the upper surface 111*a* of the midsole 111, and more specifically, is inserted into a space inside the upper 120 and thereby disposed on the upper surface 111*a* of the midsole 111.

A portion functioning as the above-described shock absorber 1 is provided at a prescribed position on the lower surface of the sockliner 114. In order to facilitate understanding, this portion is shown in dark color in the figure. The portion functioning as the shock absorber 1 in the sockliner 114 has a three-dimensional shape formed by a wall 10 having an outer shape defined by a pair of parallel flat surfaces, and includes a plurality of upper wall portions 11, a plurality of lower wall portions 12, and a plurality of upright wall portions 13 as described above. In addition, a plurality of opened portions 14 exposed to the outside are located on the side portion of the sockliner 114 in the portion functioning as the shock absorber 1.

In this case, the portion functioning as the shock absorber 1 in the sockliner 114 is provided in the substantially entire area of the lower surface of the sockliner 114, excluding the portion closer to the front end of the forefoot portion R1 and the portion closer to the rear end of the rearfoot portion R3, and is located to include a portion Q1 that supports a heel of the wearer's foot, a portion Q2 that supports a hypothenar of the wearer's foot, and a portion Q3 that supports a ball of the wearer's foot.

The sockliner 114 can be made of thermoplastic elastomer or rubber, and can be manufactured, for example, by molding such as injection molding using a mold, cast molding, sheet molding, additive manufacturing using a three-dimensional additive manufacturing apparatus, or the like.

In the shoe sole 110N described above, the shock absorber 1 is formed of a part of the sockliner 114 as described above. Thus, based on the high shock absorbing performance achieved by the portion functioning as the shock absorber 1 in the sockliner 114, the stress occurring in the shoe sole 110N at the time point when the strain energy accumulated in the shoe sole 110N during the foot landing action becomes maximum can be suppressed to be smaller. Thus, by the configuration as described above, a shoe sole dramatically enhanced in shock absorbing performance and a shoe including the shoe sole can be obtained.

SUMMARY OF THE DISCLOSURE IN EMBODIMENT AND THE LIKE

The following summarizes the characteristic configurations disclosed in the embodiment and the modifications thereof as described above.

[Supplementary Note 1]

A shoe sole includes a shock absorber and has a bottom surface configured as a ground contact surface and a top surface located opposite to the bottom surface, in which the shock absorber has a three-dimensional shape formed by a wall having an outer shape defined by a pair of parallel flat or curved surfaces, the shock absorber may buckle when the shock absorber receives compressive force applied in a normal direction to the bottom surface, when a load is applied to the shoe sole in a gradually increasing manner such that compressive force is applied to the shock absorber in the normal direction, the shock absorber starts to buckle in a state in which a stress occurring in the shock absorber is within a range from 0.15 MPa or more to 0.80 MPa or less and a strain of the shock absorber in the normal direction is within a range from 10% or more to 60% or less, and when a time point at which a strain energy density of the shock absorber reaches 0.157 J/cm$^3$ is defined as a specific time point, a maximum value of the stress occurring in the shock absorber from start of application of the compressive force to the shock absorber until the specific time point is 0.80 MPa or less, and a tangential elastic modulus of the shock absorber at the specific time point is 5.00 MPa or less.

[Supplementary Note 2]

In the shoe sole according to Supplementary Note 1, the shock absorber is disposed at least in a portion that supports a heel of a foot of a wearer.

[Supplementary Note 3]

In the shoe sole according to Supplementary Note 1 or 2, the shock absorber is disposed at least in a portion that supports a hypothenar of a foot of a wearer.

[Supplementary Note 4]

In the shoe sole according to any one of Supplementary Notes 1 to 3, the shock absorber is disposed at least in a portion that supports a ball of a foot of a wearer.

[Supplementary Note 5]

In the shoe sole according to any one of Supplementary Notes 1 to 4, the shock absorber is formed of a three-dimensional structure including a unit structure body having a three-dimensional shape formed by the wall, and the three-dimensional structure is configured by a plurality of the unit structure bodies repeatedly arranged in a regular and continuous manner at least in a direction intersecting with the normal direction.

[Supplementary Note 6]

In the shoe sole according to Supplementary Note 5, the unit structure body is formed by adding a thickness to each of divided structure units obtained by dividing a structure unit into two in one of orthogonal three-axis directions, and the structure unit is formed of a plurality of flat surfaces disposed to intersect with each other and be hollow inside.

[Supplementary Note 7]

In the shoe sole according to Supplementary Note 6, the structure unit has one of a Kelvin structure, an octet structure, a cubic structure, and a cubic-octet structure.

[Supplementary Note 8]

In the shoe sole according to Supplementary Note 5, the unit structure body is formed by adding a thickness to each of divided structure units obtained by dividing a structure unit having a triply periodic minimal surface into two in one of orthogonal three-axis directions.

[Supplementary Note 9]

In the shoe sole according to Supplementary Note 8, the structure unit has one of a Schwartz P structure, a gyroid structure, and a Schwartz D structure.

[Supplementary Note 10]

The shoe sole according to any one of Supplementary Notes 1 to 9 further includes:

a midsole formed of a material lower in rigidity than a material of the shock absorber, the midsole having an upper surface defining the top surface; and an outsole that covers a lower surface of the midsole and defines the bottom surface, in which the shock absorber is embedded in the midsole such that an upper surface of the shock absorber defines the top surface and a lower surface of the shock absorber reaches the outsole.

[Supplementary Note 11]

The shoe sole according to any one of Supplementary Notes 1 to 9 further includes:

a midsole formed of a material lower in rigidity than a material of the shock absorber, the midsole having an upper surface defining the top surface; and a highly rigid plate formed of a material higher in rigidity than a material of the midsole, in which the highly rigid plate is embedded in the midsole to extend in a direction intersecting with the normal direction, and the shock absorber is embedded in the midsole such that an upper surface of the shock absorber defines the top surface and a lower surface of the shock absorber reaches the highly rigid plate.

[Supplementary Note 12]

The shoe sole according to any one of Supplementary Notes 1 to 9 further includes:

a midsole formed of a material lower in rigidity than a material of the shock absorber, the midsole having an upper surface defining the top surface;

an outsole that covers a lower surface of the midsole and defines the bottom surface; and a highly rigid plate formed of a material higher in rigidity than a material of the midsole, in which the highly rigid plate is embedded in the midsole to extend in a direction intersecting with the normal direction, and the shock absorber is embedded in the midsole such that an upper surface of the shock absorber reaches the highly rigid plate and a lower surface of the shock absorber reaches the outsole.

[Supplementary Note 13]

The shoe sole according to any one of Supplementary Notes 1 to 9 further includes:

a midsole formed of a material lower in rigidity than a material of the shock absorber, the midsole having an upper surface defining the top surface;

an outsole that covers a lower surface of the midsole and defines the bottom surface; and an upper highly rigid plate and a lower highly rigid plate each formed of a material higher in rigidity than a material of the midsole, in which the upper highly rigid plate is disposed to cover the upper surface of the midsole so as to extend in a direction intersecting with the normal direction, the lower highly rigid plate is disposed to cover the lower surface of the midsole so as to extend in a direction intersecting with the normal direction, and the shock absorber is embedded in the midsole such that an upper surface of the shock absorber reaches the upper highly rigid plate and a lower surface of the shock absorber reaches the lower highly rigid plate.

[Supplementary Note 14]

The shoe sole according to any one of Supplementary Notes 1 to 9 includes:

a midsole formed of a material lower in rigidity than a material of the shock absorber; and an outsole that covers a lower surface of the midsole and defines the bottom surface, in which the shock absorber is formed of at least a part of the outsole.

[Supplementary Note 15]

The shoe sole according to any one of Supplementary Notes 1 to 9 includes:

a midsole formed of a material lower in rigidity than a material of the shock absorber; and a sockliner that covers an upper surface of the midsole and defines the top surface, in which the shock absorber is formed of at least a part of the sockliner.

[Supplementary Note 16]

A shoe includes:

the shoe sole according to any one of Supplementary Notes 1 to 15; and an upper provided above the shoe sole.

Other Embodiments

The above embodiment and the modifications thereof have been described with reference to an example in which a shock absorber is provided in a part of a shoe sole including a midsole and an outsole, but the shoe sole may be entirely formed of a shock absorber or a shock absorber may be provided in a shoe sole not including a midsole or an outsole.

Further, the above embodiment and the modifications thereof have been described with reference to an example in which the shock absorber is configured to have not only an upright wall portion but also an upper wall portion and a lower wall portion, but the shock absorber may be configured not to have one of the upper wall portion and the lower wall portion or both the upper wall portion and the lower wall portion. In other words, since buckling that improves the shock absorbing performance occurs mainly in the upright wall portion, the upper wall portion and the lower wall portion are not essential components as long as the shock absorber can be installed into a shoe sole in some way.

Further, the above embodiment and the modifications thereof have been described with reference to an example in which a shock absorber is formed by adding a thickness to each of divided structure units obtained by dividing a structure unit having a geometrical surface structure into two in one of the orthogonal three-axis directions, but the shock absorber does not necessarily have to be configured in this way. In other words, any shock absorber may be applicable as long as the shock absorber is configured to have a three-dimensional shape formed by a wall having an outer shape defined by a pair of parallel flat or curved surfaces, and the shock absorber buckles within the required stress range and the required strain range as described above, and thereby, the above-mentioned maximum stress becomes equal to or less than the above-described prescribed value, and the tangential elastic modulus of the shock absorber at the specific time point becomes equal to or less than the above-described prescribed value. Further, even when a shock absorber is formed by adding a thickness to each of divided structure units obtained by dividing a structure unit having a geometrical surface structure into two in one of the orthogonal three-axis directions, modifications may be made as appropriate, for example, by chamfering a corner portion, changing the thickness from part to part, or slightly changing the shape of the unit structure body.

Further, the above embodiment and the modifications thereof have been described with reference to an example in which the present invention is applied to a shoe including a shoe tongue and a shoelace, but the present invention may also be applicable to a shoe not including a shoe tongue and a shoelace (for example, a shoe including a sock-shaped upper) and a shoe sole included in the shoe.

Further, the characteristic configurations disclosed in the above embodiment and the modifications thereof can be combined with each other without departing from the gist of the present invention.

Although the embodiments of the present invention have been described, it should be understood that the embodiments disclosed herein are illustrative and not restrictive in all respects. The scope of the present invention is defined by the terms of the claims and is intended to include any modifications within the meaning and scope equivalent to the terms of the claims.

What is claimed is:

1. A shoe sole comprising a shock absorber, the shoe sole having a bottom surface configured as a ground contact surface, and a top surface located opposite to the bottom surface, wherein the shock absorber has a three-dimensional shape configured by a wall having an outer shape defined by a pair of opposed flat or curved surfaces, the wall consisting of a plurality of upright wall portions, one upper wall portion, and a plurality of divided lower wall portions, each of the upright wall portions extending to intersect the upper wall portion and a corresponding one of the plurality of lower wall portions, an entire surface area of the upright wall portions, the upper wall portion, and the lower wall portions being continuous, the upper wall portion being flat, and each of the lower wall portions being flat and parallel to the upper wall portion, the shock absorber is configured to buckle when the shock absorber receives compressive force applied in a normal direction to the bottom surface, when a load is applied to the shoe sole in a gradually increasing manner such that compressive force is applied to the shock absorber in the normal direction, the shock absorber is configured to start to buckle when a stress occurring in the shock absorber is within a range from 0.15 MPa to 0.80 MPa and a strain of the shock absorber in the normal direction is within a range from 10% to 60%, and when a time point at which a strain energy density of the shock absorber reaches 0.157 $J/cm^3$ is defined as a specific time point, a maximum value of the stress occurring in the shock absorber from start of application of the compressive force to the shock absorber until the specific time point is 0.80 MPa or less, and an elastic modulus of the shock absorber at the specific time point is 5.00 MPa or less.

2. The shoe sole according to claim 1, wherein the shock absorber is disposed at least in a portion that is configured to support a heel of a foot of a wearer.

3. The shoe sole according to claim 1, wherein the shock absorber is disposed at least in a portion that is configured to support a hypothenar of a foot of a wearer.

4. The shoe sole according to claim 1, wherein the shock absorber is disposed at least in a portion that is configured to support a ball of a foot of a wearer.

5. The shoe sole according to claim 1, wherein the shock absorber is configured of a three-dimensional structure including a unit structure body having a three-dimensional shape configured by the wall, and the three-dimensional structure is configured by a plurality of the unit structure bodies repeatedly arranged in a regular and continuous manner at least in a direction intersecting with the normal direction.

6. The shoe sole according to claim 5, wherein the unit structure body is configured by adding a thickness to each of a plurality of divided structure units obtained by dividing each structure unit of the plurality of divided structure units into two units in at least one orthogonal three-axis direction, and the structure unit includes a plurality of flat surfaces which intersect with each other and are hollow inside.

7. The shoe sole according to claim 6, wherein the structure unit has one of a Kelvin structure, an octet structure, a cubic structure, and a cubic-octet structure.

8. The shoe sole according to claim 5, wherein the unit structure body is configured by adding a thickness to each of a plurality of divided structure units having a triply periodic minimal surface into two units in at least one orthogonal three-axis direction.

9. The shoe sole according to claim 8, wherein the structure unit has one of a Schwartz P structure, a gyroid structure, and a Schwartz D structure.

10. The shoe sole according to claim 1, further comprising:

a midsole including a material lower in rigidity than a material of the shock absorber, the midsole having an upper surface defining the top surface; and an outsole that covers a lower surface of the midsole and defines the bottom surface, wherein the shock absorber is embedded in the midsole such that an upper surface of the shock absorber defines the top surface and a lower surface of the shock absorber reaches the outsole.

11. The shoe sole according to claim 1, further comprising:

a midsole including a material lower in rigidity than a material of the shock absorber, the midsole having an upper surface defining the top surface; and a rigid plate including a material higher in rigidity than a material of the midsole, wherein the rigid plate is embedded in the midsole to extend in a direction intersecting with the normal direction, and the shock absorber is embedded in the midsole such that an upper surface of the shock absorber defines the top surface and a lower surface of the shock absorber reaches the rigid plate.

12. The shoe sole according to claim 1, further comprising:

a midsole including a material lower in rigidity than a material of the shock absorber, the midsole having an upper surface defining the top surface;

an outsole that covers a lower surface of the midsole and defines the bottom surface; and a rigid plate including a material higher in rigidity than a material of the midsole, wherein the rigid plate is embedded in the midsole to extend in a direction intersecting with the normal direction, and the shock absorber is embedded in the midsole such that an upper surface of the shock absorber reaches the rigid plate and a lower surface of the shock absorber reaches the outsole.

13. The shoe sole according to claim 1, further comprising:

a midsole including a material lower in rigidity than a material of the shock absorber, the midsole having an upper surface defining the top surface;

an outsole that covers a lower surface of the midsole and defines the bottom surface; and an upper rigid plate and a lower rigid plate each including a material higher in rigidity than a material of the midsole, wherein the upper rigid plate is disposed to cover the upper surface of the midsole so as to extend in a direction intersecting with the normal direction, the lower rigid plate is disposed to cover the lower surface of the midsole so as to extend in a direction intersecting with the normal direction, and the shock absorber is embedded in the midsole such that an upper surface of the shock absorber reaches the upper rigid plate and a lower surface of the shock absorber reaches the lower rigid plate.

14. The shoe sole according to claim 1, comprising:

a midsole including a material lower in rigidity than a material of the shock absorber; and an outsole that covers a lower surface of the midsole and defines the bottom surface, wherein the shock absorber includes at least a part of the outsole.

15. The shoe sole according to claim 1, comprising:

a midsole including a material lower in rigidity than a material of the shock absorber; and a sockliner that covers an upper surface of the midsole and defines the top surface, wherein the shock absorber includes at least a part of the sockliner.

16. A shoe comprising:

the shoe sole according to claim 1; and an upper above the shoe sole.

* * * * *